US006813458B2

(12) United States Patent
Furumizu

(10) Patent No.: US 6,813,458 B2
(45) Date of Patent: Nov. 2, 2004

(54) IMAGE FORMING APPARATUS

(75) Inventor: Mikio Furumizu, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/244,135

(22) Filed: Sep. 16, 2002

(65) Prior Publication Data

US 2003/0063922 A1 Apr. 3, 2003

(30) Foreign Application Priority Data

| | | |
|---|---|---|
| Sep. 14, 2001 | (JP) | 2001-279911 |
| Sep. 14, 2001 | (JP) | 2001-279912 |
| Sep. 18, 2001 | (JP) | 2001-283053 |
| Sep. 21, 2001 | (JP) | 2001-288379 |
| Sep. 21, 2001 | (JP) | 2001-288380 |
| Sep. 21, 2001 | (JP) | 2001-288381 |
| Sep. 21, 2001 | (JP) | 2001-288382 |
| Sep. 21, 2001 | (JP) | 2001-288383 |

(51) Int. Cl.[7] ..... G03G 15/16
(52) U.S. Cl. ..... 399/149; 399/302
(58) Field of Search ..... 399/149, 302; 430/110.3, 124

(56) References Cited

U.S. PATENT DOCUMENTS

| | | | | |
|---|---|---|---|---|
| 5,066,982 A | * | 11/1991 | Hosoya et al. | 399/150 |
| 5,084,735 A | | 1/1992 | Rimai et al. | |
| 6,146,802 A | | 11/2000 | Okada et al. | |
| 6,165,663 A | | 12/2000 | Baba et al. | |
| 6,278,858 B1 | * | 8/2001 | Nakazawa et al. | 399/302 |
| 6,468,707 B1 | * | 10/2002 | Okuno et al. | 430/126 |
| 6,560,436 B1 | * | 5/2003 | Liu | 399/314 |
| 6,605,401 B2 | * | 8/2003 | Okada et al. | 430/108.1 |
| 6,640,071 B2 | * | 10/2003 | Okada | 399/150 |

FOREIGN PATENT DOCUMENTS

| | | |
|---|---|---|
| EP | 1 220 043 A2 | 7/2002 |
| JP | 5-503377 | 6/1993 |
| JP | 6-332324 | 12/1994 |
| JP | 2000-267303 | 9/2000 |

OTHER PUBLICATIONS

Schaffert "Electrophotography" Focal Press 1975 pp. 52–55.*

Japanese Abstract No. 2001022114, dated Jan. 26, 2001.

* cited by examiner

*Primary Examiner*—John L Goodrow
(74) *Attorney, Agent, or Firm*—Sughrue Mion, PLLC

(57) ABSTRACT

An image forming apparatus of cleaner-less system using toner particles comprising resin mother particles coated with external additives, having an adhesive force between a primary transfer member and the toner particle that is larger than the adhesive force between an image carrier and the toner particle, and an adhesive force between the primary transfer member and the resin mother particle that is larger than the adhesive force between the image carrier and the resin mother particle. As a result, a stable transfer property is provided which prevents the generation of residual toner particles. Furthermore, when images with toner particles of different colors are superposed at the transfer portion, color-to-color separation of the toner particles can be prevented by setting the adhesive force between the resin mother particles of the different colors to be larger than the adhesive force between the image carrier and the resin mother particle.

25 Claims, 14 Drawing Sheets

IMAGE FORMING APPARATUS

BACKGROUND OF THE INVENTION

The present invention relates to an image forming apparatus employing a toner which is prepared by coating the surfaces of resin mother particles with external additives.

In a full-color electrophotography, an intermediate transfer member is employed for the purpose of preventing wear of a photoreceptor and of facilitating superposition of multi-color images. In addition, used toners are small particle toners of 20 $\mu$m or less or 10 $\mu$m or less in diameter for giving improved resolution. The small particle toner has however poor transfer property compared to a large particle toner. If the transfer electric field is enhanced to improve the transfer, dielectric breakdown can unfortunately occur and be followed by image defects. The transfer property depends on the adhesive forces (van der Waals forces, image-forces) between the toner and the photoreceptor and between the toner and the intermediate transfer member.

In order to improve the transfer property, it has been therefore proposed that the adhesive force between the intermediate transfer member and the toner is set to be larger than the adhesive force between the photoreceptor and the toner and, in addition, the adhesive force between the toner and a receiving sheet is set to be larger than the adhesive force between the intermediate transfer member and the toner (Japanese Unexamined Patent Publication No. H05-503377).

By the way, a single-component non-magnetic toner is generally formed by coating the surfaces of resin mother particles with external additives to reduce the adhesive force of the toner and improve the charging property. In a developing device using such a toner, the toner is supplied to a development roller by a supply roller while being agitated and is regulated into a toner layer having a certain thickness on the development roller and triboelectrically charged by a regulating blade. In this manner, the toner is carried to a nip portion relative to the photoreceptor. In normal operation, toner particles which move from the development roller to the photoreceptor for the consumption may account for a several percent of the toner at the most. The rest is returned to the developing device again for the agitation and the triboelectric charging. The circulation of the toner is repeated. In this process, toner particles which are well coated with external additives and have good charging property are consumed prior to other particles (this phenomenon will be referred to as "selective development").

As a result of such selective development, circulated toner particles in the developing device are deteriorated so that a part of the external additives may be embedded into the resin mother particle and a part of the external additives may be released from the surface of the resin mother particle to as to expose the resin surface of the mother particle. Even in a new toner, not all mother particles have surfaces sufficiently coated with external additives. This means that the toner includes, by a several percent, liberated mother particles insufficiently coated with external additives. As a result, the adhesive force of toner particles sufficiently coated with external additives significantly depends on the effects of the external additives while the adhesive force of toner particles in which the amount of external additives on toner surfaces is reduced according to the repetition of circulation and the adhesive force of liberated mother particles significantly depends on the effect of the resin mother particles.

The invention proposed in the aforementioned Japanese Unexamined Patent Publication No. H05-503377, however, has been made without taking such reduction in amount of external additives according to the repetition of circulation and such liberated mother particles into consideration. This is because the transfer efficiency could not be sufficiently improved, leading to reduction in transfer efficiency. In case of an apparatus with a cleaner, there may be no problem caused due to the reduction in transfer efficiency because the residual toner particles are removed. In case of an apparatus without a cleaner, i.e. conducting a cleaner-less process, the reduction in transfer efficiency can produce a ghost image and color mixture due to reverse transfer as well as color difference.

Though toner particles are coated with external additives to improve the charging property, a several percent of a toner is liberated mother particles insufficiently coated with external additives as described above. In addition, in case of a single-component developing method, parts of external additive released from toner surfaces or embedded into resin mother particles due to the repetition of circulation, thus reducing the amount of external additives on the surfaces of the toner particles. Such liberated mother particles and toner particles deteriorated due to the repetition of circulation may have reduced charging property so as to produce defects in charging, leading to reduction in transfer property from photoreceptor to the intermediate transfer member by triboelectric force and thus generating residual toner particles of the apparatus. The adhesive force of the liberated mother particle or the deteriorated toner particle relative to a member may be so large to undesirably cause reverse transfer that toner particles are transferred from the intermediate transfer member to the photoreceptor when the toner particles arrive in the nip portion again. In a conventional image forming apparatus, residual toner particles after transfer are removed by a cleaner. On the other hand, a cleaner-less image forming apparatus permits of neither generation of residual toner particles nor reverse transfer.

Since liberated mother particles and deteriorated toner particles have reduced charging property and reduced transfer property, residual toner particles may be generated. The reduction in transfer property of toner particles can cause various problems. For example, toner particles of different colors may not be superposed on the other and separately adhere to the photoreceptor and to the intermediate transfer member during superposition of multi-color images on the intermediate transfer member (this phenomenon will be called "color-to-color separation"). In addition, in the next cycle of superposing multi-color images, such toner particles may be reversely transferred from the intermediate transfer member to the photoreceptor. Such phenomenon is a serious problem particular in the cleaner-less image forming apparatus.

The charging property of liberated mother particles and deteriorated toner particles is reduced and the transfer property thereof is thus reduced, leading to generation of residual toner particles. In case that the toner in the form of multi-story adhering to the intermediate transfer member includes normally charged toner particles and insufficiently charged toner particles, separation is caused between the normally charged toner particles and the insufficiently charged toner particles when the toner is transferred to a sheet of paper (this phenomenon will now be called "story-to-story separation"). Residual toner particles are therefore generated onto the intermediate transfer member so as to create hollow defects on the image formed on a sheet of paper, thus leading to degradation in image quality.

In a primary transfer of transferring the toner from the photoreceptor to the intermediate transfer member, a transfer bias is applied to prevent the generation of residual toner particles. When the photoreceptor and the intermediate transfer member are about to separate from each other after the transfer, electric discharge is easily generated particularly at non-image areas because of the application of the transfer bias. Due to this electric discharge, toner particles transferred onto the intermediate transfer member may be charged into an opposite polarity and reversely transferred to the photoreceptor because of a transfer electric field, resulting in color mixture and/or generation of residual toner particles on the photoreceptor. On the intermediate transfer member, toner particles are partially omitted so as to create defects of transferred colorant, sometimes resulting in serious image defects. Such phenomenon may be caused in the secondary transfer.

In the secondary transfer of transferring the toner from the intermediate transfer member to a receiving medium, a transfer bias is applied to prevent the generation of residual toner particles. When the transfer bias is applied, an electric discharge easily occurs at a transfer portion. Toner particles transferred onto the receiving medium may be charged into an opposite polarity due to ions generated by the electric discharge and returned to the intermediate transfer member (reverse transfer) because of the transfer electric field so that residual transfer particles are generated on the intermediate transfer member and that toner particles are partially omitted to create defects of transferred colorant on the receiving medium, resulting in serious image defects.

SUMMARY OF THE INVENTION

It is an object of the present invention to obtain stable transfer property regardless of the repetition of circulation of toner particles.

It is another object of the present invention to prevent the generation of residual toner particles to accomplish the cleaner-less arrangement of an image forming apparatus.

It is still another object of the present invention to prevent the generation of residual toner particles, color-to-color separation of a toner, and reverse transfer.

It is further another object of the present invention to prevent the occurrence of story-to-story separation of a multi-story toner when transferred from an intermediate transfer member to a sheet of paper, thereby preventing generation of residual toner particles and preventing the degradation in image quality.

It is yet another object of the present invention to prevent the creation of defects of transferred colorant created due to electric discharge at a transfer portion, thereby preventing the creation of serious image defects.

The present invention therefore provides an image forming apparatus of cleaner-less system using toner particles comprising resin mother particles of which surfaces are coated with external additives, wherein the adhesive force between a primary transfer member and the toner particle is larger than the adhesive force between an image carrier and the toner particle and wherein the adhesive force between the primary transfer member and the resin mother particle is larger than the adhesive force between the image carrier and the resin mother particle.

The present invention still provides an image forming apparatus of cleaner-less system using toner particles comprising resin mother particles of which surfaces are coated with external additives, wherein the adhesive force between the resin mother particles is larger than the adhesive force between the resin mother particle and the image carrier.

The present invention yet provides an image forming apparatus of cleaner-less system using toner particles comprising resin mother particles of which surfaces are coated with external additives, wherein the adhesive force between the resin mother particle and the image carrier is smaller than the adhesive force between the resin mother particles and than the adhesive force between the resin mother particle and a transfer member.

Further, the present invention provides an image forming apparatus using toner particles comprising resin mother particles of which surfaces are coated with external additives, in which images with toner particles of different colors are superposed at a transfer portion, wherein the adhesive force between the resin mother particles of at least two different colors is larger than the adhesive force between the image carrier and the resin mother particle.

Furthermore, the present invention provides an image forming apparatus using toner particles comprising resin mother particles of which surfaces are coated with external additives, in which images with toner particles of different colors are superposed at a transfer portion, wherein the adhesive force between the resin mother particle and the image carrier is smaller than the adhesive force between the resin mother particles of at least two different colors and than the adhesive force between the resin mother particle and a transfer member.

Still further, the present invention provides an image forming apparatus having an intermediate transfer member and using toner particles comprising resin mother particles of which surfaces are coated with external additives, wherein the adhesive force between the resin mother particles is larger than the adhesive force between the resin mother particle and the intermediate transfer member.

In addition, the present invention provides an image forming apparatus having an intermediate transfer member and using toner particles comprising resin mother particles of which surfaces are coated with external additives, wherein the adhesive force between the toner particle and the intermediate transfer member or a receiving medium is larger than the adhesive force between the toner particles.

Further, the present invention provides image forming apparatus having an intermediate transfer member and using toner particles comprising mother particles of which surfaces are coated with external additives, wherein the adhesive force between the toner particles is larger than the adhesive force between the toner particle and the intermediate transfer member and wherein the adhesive force between the toner particle and a receiving medium is larger than the adhesive force between the toner particles.

DESCRIPTION OF THE PREFERRED EMBODIMENTS

Hereinafter, embodiments of the present invention will be explained with reference to drawings.

Figure 1:
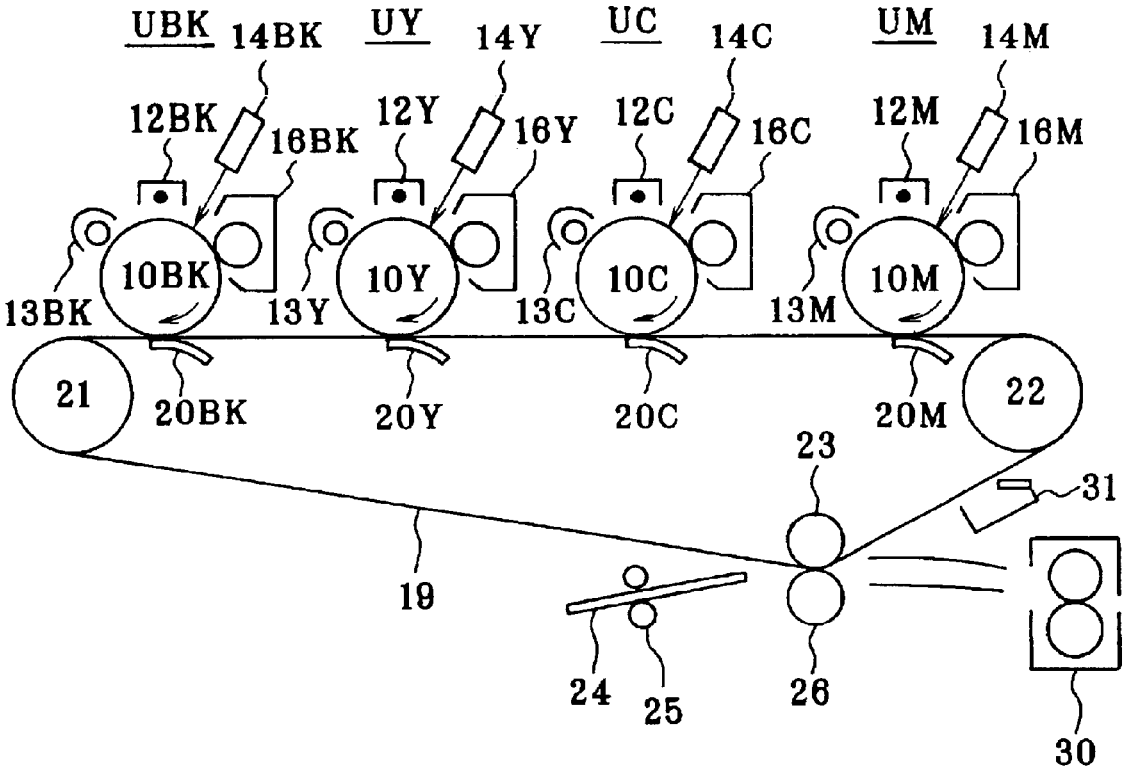
FIG. 1 is an illustration of a cleaner-less image forming apparatus of tandem type.

FIG. 1 is an illustration showing a structural example of a cleaner-less image forming apparatus of tandem type, to which the first aspect of the invention is adopted. It should be noted that the first aspect of the invention is not limited to the tandem type and can be adopted to any type of image forming apparatuses.

In FIG. 1, mark UM designates an image forming unit for forming a magenta image, UC designates an image forming unit for forming a cyan image, UY designates an image forming unit for forming an yellow image, and UBk designates an image forming unit for forming a black image. These image forming units have photoreceptor drums (image carriers) 10M, 10C, 10Y, and 10Bk, respectively. Arranged around each photoreceptor drum are a charging unit 12M, 12C, 12Y, or 12Bk, an charge removing unit 13M, 13C, 13Y, or 13Bk, an exposing unit 14M, 14C, 14Y, or 14Bk, and a developing device 16M, 16C, 16Y, or 16Bk. Images of M, C, Y, and Bk are formed onto the photoreceptor drums, respectively. The respective photoreceptor drums are in contact with an intermediate transfer member 19 driven by belt driving rollers 21, 22. Transfer blades 20M, 20C, 20Y, and 20Bk are arranged opposite to the corresponding photoreceptor drums via the intermediate transfer member, respectively. The transfer blades apply transfer electric fields so that images on the respective photoreceptor drums are transferred to the intermediate transfer member 19, thereby superposing multi-color images. It should be noted that transfer rollers may be employed instead of the transfer blades.

The superposed multi-color images on the intermediate transfer member 19 are transferred to a receiving medium 24 supplied by a feed roller 25. This transfer is conducted with a transfer electric field applied by a secondary transfer roller 26 which is disposed opposite to a backup roller 23. Then, the transferred images are fixed to the receiving medium by a fixing unit 30. Residual toner particles remaining on the intermediate transfer member are removed by a belt cleaner 31.

In an image forming apparatus of tandem type, the transfer efficiency of nearly 100% is achieved for the transfer from the photoreceptor drums to the intermediate transfer member. Therefore, no cleaner is provided for cleaning the photoreceptor drums. This can shorten the distances between the respective image forming units, thereby making the entire apparatus smaller.

Figure 2:
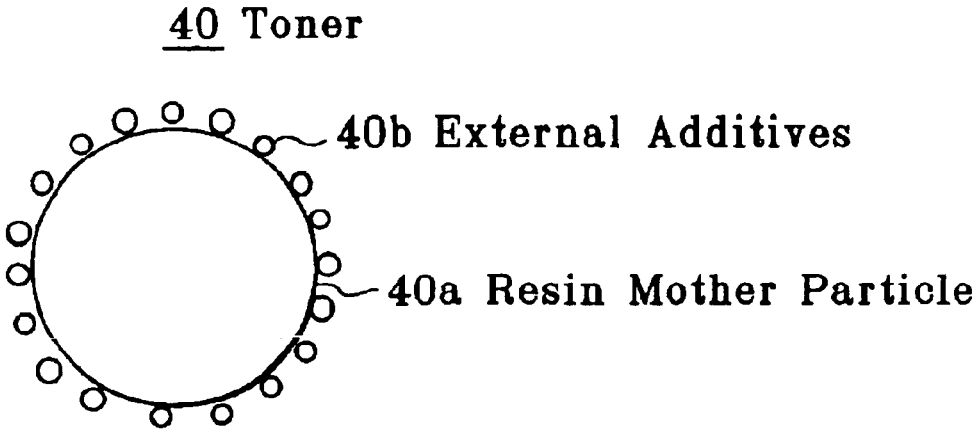
FIG. 2 is an illustration schematically showing a toner particle to be used in the present invention.

FIG. 2 is an illustration schematically showing a toner particle to be used in embodiments of the present invention.

Each toner particle 40 is a small size toner particle of 10 $\mu$m or less for use in reproduction of images with high resolution and comprises a mother particle 40*a* of which surface is coated with external additives 40*b* for improving the charging property and reducing the adhesive force.

Figure 3:
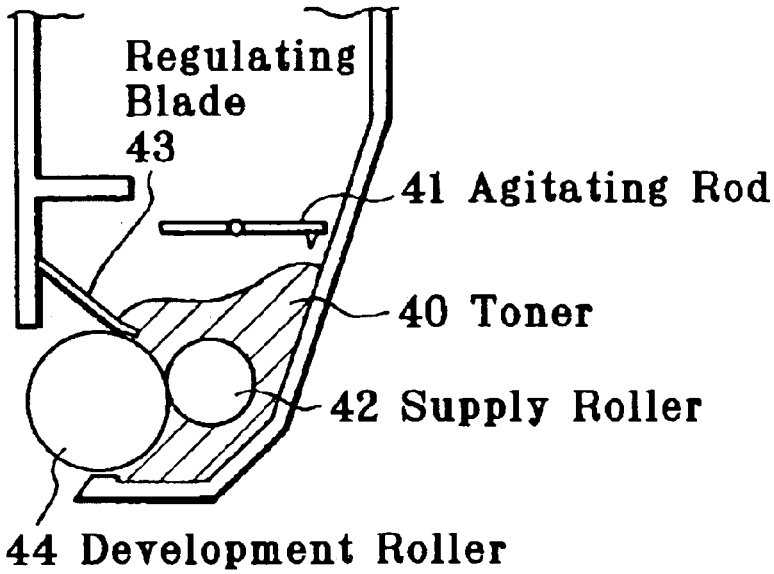
FIG. 3 is an illustration for explaining an example of a developing device of a single-component non-magnetic developing type.
Figure 4A:
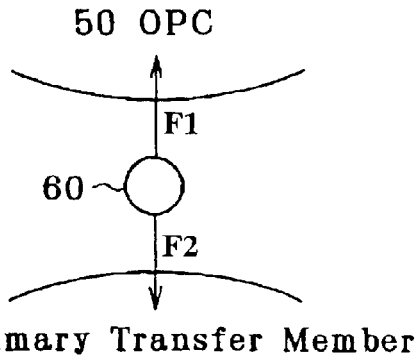
FIGS. 4(*a*)–4(*d*) are diagrams schematically showing the relations in adhesive forces between toner particles and a photoreceptor and between toner particles.
Figure 4B:
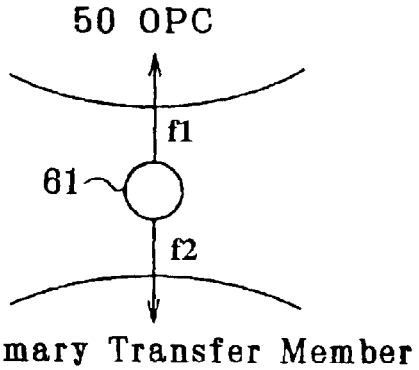
Figure 4C:
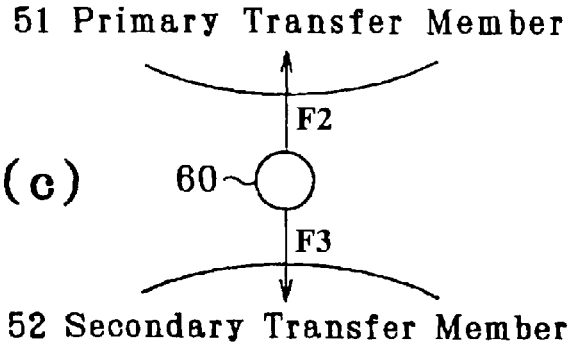
Figure 4D:
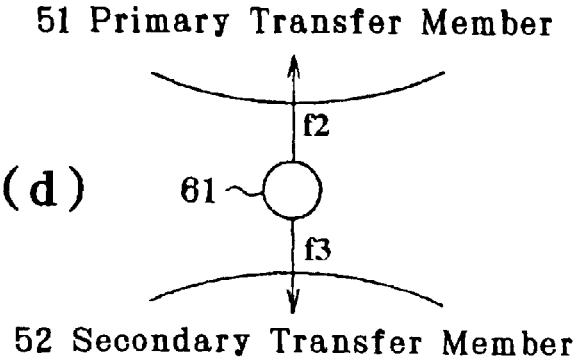

FIG. 3 is an illustration for explaining an example of a developing device of a single-component non-magnetic developing type used in the embodiments of the present invention.

The toner particles 40, as shown in FIG. 2, are agitated by an agitating rod 41. Then, the toner particles 40 are supplied to a development roller 44 by a supply roller 42 and are rubbed on the surface of the development roller 44 so that the particles are triboelectriccally charged. Further, the toner particles 40 are regulated into a layer of which thickness is fixed by a regulating blade 43 and are triboelectrically charged before carried to a nip portion relative to the photoreceptor. Toner particles not used for development are returned to the inside of the developing device and the toner particles are subjected to be agitated, triboelectrically charged by the supply roller, and triboelectrically charged by the regulating blade again. This circulation of the toner is repeated. In the deployment, new toner particles having good charging property and having neat charging distribution are consumed prior to the others. That is, the selective development is conducted. As the ratio of toner particles not consumed for deployment is calculated from the consumed amount of toner particles, the number of sheets to be printed, and the amount of toner particles carried onto the development roller during the lifetime of the deploying device, the percentage of such toner particles is about 95%. The mentioned much amount of toner particles are not consumed and are repeatedly returned to the inside of the deploying device. As a result of the repetition of circulation, a part of the external additives may be embedded into the resin mother particle and a part of the external additives may be released from the resin mother particle, thereby reducing the amount of the external additives on the surface of the toner particle. Even in a new toner, a several percent of mother particles are insufficiently coated with external additives. Toner particles sufficiently coated with external additives can provide good transfer efficiency because of its good charging property and its small adhesive force. On the other hand, toner particles with reduced amount of external additives according to the repetition of circulation and/or liberated mother particles can provide poor transfer efficiency because its adhesive force is increased and its charging property is reduced.

For this, in the first aspect of the invention, toner particles in the initial state being sufficiently coated with external additives and even deteriorated toner particles and liberated mother particles can provide sufficient transfer efficiency. This is shown in FIGS. 4(*a*)–4(*d*).

FIGS. 4(*a*)–4(*d*) are diagrams schematically showing the relations in adhesive forces between a toner particle and a photoreceptor and between toner particles, wherein FIG. 4(*a*) and FIG. 4(*c*) show a case of a toner particle of which surface is sufficiently coated with external additives, and FIG. 4(*b*) and FIG. 4(*d*) show a case of a toner particle which is deteriorated or in which the amount of external additives on its surface is reduced i.e. a liberated mother particle. It is assumed here that an image is transferred from the photoreceptor 50 to the primary transfer member 51 and from the primary transfer member 51 to the secondary transfer member 52.

In FIG. 4(*a*), it is assumed that the adhesive force between a toner 60, sufficiently coated with external additives, and the photoreceptor 50 is F1, and that the adhesive force between the toner 60 and the primary transfer member 51 is F2. The relation between F1 and F2 is set to satisfy the following expression:

$$F1<F2 \quad (1)$$

In FIG. 4(*b*), it is assumed that the adhesive force between a deteriorated toner particle or a liberated mother particle i.e. a resin mother particle 61, insufficiently coated with external additives, and the photoreceptor 50 is f1 and that the adhesive force between the resin mother particle 61 and the primary transfer member 51 is f2. The relation between f1 and f2 is set to satisfy the following expression:

$$f1<f2 \quad (2)$$

If the above expressions (1) and (2) are satisfied, 100% transfer efficiency can be theoretically achieved with any of toner particles including toner particles sufficiently coated with external additives, deteriorated toner particles and liberated mother particles.

When the following expression is satisfied on the condition that the above expressions (1) and (2), 100% transfer efficiency can be theoretically achieved for the transfer from the primary transfer member to the secondary transfer member. In FIG. 4(*c*), it is assumed that the adhesive force between the toner 60 sufficiently coated with external additives and the primary transfer member 51 is F2 and that the adhesive force between the toner 60 and the secondary transfer member 52 is F3. The relation between F2 and F3 is set to satisfy the following expression:

$$F2<F3 \quad (3)$$

In FIG. 4(*d*), it is assumed that the adhesive force between a deteriorated toner particle or a liberated mother particle i.e. the resin mother particle 61, insufficiently coated with external additives, and the primary transfer member 51 is f2 and that the adhesive force between the resin mother particle 61 and the secondary transfer member is f3. The relation between f2 and f3 is set to satisfy the following expression:

$$f2<f3 \quad (4)$$

If the above expressions (3), (4) are satisfied, 100% transfer efficiency from the primary transfer member to the secondary transfer member can be theoretically achieved with any of toner particles including toner particles sufficiently coated with external additives, deteriorated toner particles and liberated mother particles. By maintaining the aforementioned relations, sufficient transfer efficiency is always provided, thereby at least achieving the cleaner-less arrangement of the photoreceptor.

Now, description will now be made as regard to structural examples of the photoreceptor and the intermediate transfer member for satisfying the aforementioned expressions.

The following are examples of the photoreceptor for satisfying the aforementioned expressions:

(I) a photoreceptor in which a resin making the outermost layer of the photoreceptor is selected to make the photoreceptor to have lower surface energy;

(II) a photoreceptor in which a surface active agent is added into the outermost layer of the photoreceptor so as to have the water repellency and the lipophilic property; and (III) a photoreceptor in which a material having high releasing property is dispersed into the outermost layer of the photoreceptor.

In the above example (I), a material selected from a fluorine-containing group and a silicon-containing group is introduced into the structure of the resin.

In the above example (II), examples to be added are polyoxyalkene alkyl ethers, polyoxyalkene alkyl phenyl ethers, polyoxyalkene sorbitan fatty acid esters, and fatty acid monoglycerides polyethyleneglycol fatty acid esters. Examples to be applied are calcium stearate, potassium stearate, zinc stearate, iron stearate, barium stearate, nickel stearate, cobalt stearate, copper stearate, strontium stearate, cadmium stearate, magnesium stearate, cobalt oleate, zinc oleate, manganese oleate, iron oleate, zinc palmitate, cobalt palmitate, copper palmitate, magnesium palmitate, aluminum palmitate, calcium palmitate, lead caprylate, copper caprylate, zinc linolenate, cobalt linolenate, and calcium linolenate (Japanese Patent Unexamined Publication No. 2000-267303, Japanese Patent Unexamined Publication No. H06-332324).

In the above example (III), fluorine fine particles are dispersed. A mixture is prepared by solving a triphenolamine compound, a hole transport material, into a polycarbonate resin by a weight ratio 10:8. polytetrafluoroethylene fine particles (particle diameter of 0.1–0.3 μm) are dispersed into the mixture by 5–50 parts by weight relative to the total in the solid state. One or more is suitably selected from a group consisting of tetrafluoroethylene resin, chlorotrifluoroethylene resin, ethylene-propylene hexafluoride resin, vinyl fluoride resin, vinylidene fluoride resin, ethylene dichloride difluoride resin, and copolymers of the above resins.

In Example 1, as the photoreceptor, one of the above photoreceptors (I), (II), and (III) is employed. As the belt material of the intermediate transfer member, a material prepared by introducing a fluorine-containing group or a silicon-containing group into urethane, polyester, polycarbonate, PET, or the like is used. The surface roughness of the photoreceptor (Ra=0.07 μm)<the surface roughness of the intermediate transfer member (Ra=0.03 μm). New toner particles and toner particles after deteriorated due to repetition of circulations are compressed to be formed into tablets, respectively. These tablets are pressed against the photoreceptor and the intermediate transfer member. In this state, the photoreceptor and the intermediate transfer member are driven to develop torques. From these torques, the adhesive forces of the toner particles are computed. Example 1 will be described.

EXAMPLE 1

A toner X in the initial state (state α) is compressed at 100–500 kgf/cm$^2$ into a tablet. It is preferable to satisfy the following expression:

$$A<B<C$$

wherein A is a difference between the torque when the image carrier is driven with the tablet being pressed against the image carrier at 20 gf/cm$^2$–400 gf/cm$^2$ and the torque when the image carrier is driven alone, B is a difference between the torque when the primary transfer member is driven with the tablet being pressed against the primary transfer member at the aforementioned load and the torque when the primary transfer member is driven alone, and C is a difference between the torque when the secondary transfer member (receiving medium) is driven with the tablet being pressed against the secondary transfer member (receiving medium) and the torque when the secondary transfer member (receiving medium) is driven alone. After the development roller is rotated with the toner X at a peripheral velocity of 350 mm/sec for 50 minutes (corresponding to printing white solid images on 2000 sheets of paper (A4)) (state β), the toner X is compressed into a tablet in the same manner as mentioned above. Assuming that the differences in torque measured in the same manner under this condition are A', B', and C', respectively, it is preferable to satisfy the following expression:

$$A'<B'<C'$$

By using the toner X satisfying the above expressions, the transfer efficiencies are measured, with the results that the transfer efficiency of 99.8–100% is achieved in the initial state (state α) and that the transfer efficiency of 99.4–99.8% is achieved after deteriorated (state β). It should be noted that the toner X is a polymerized toner of which degree of sphericity is 0.96.

By using a particle analyzer (PT-1000 (available from Yokogawa Electric Corporation)), the new toner and the deteriorated toner are measured whether external additives coat surfaces of toner particles (synchronous external additive particles) and whether external additive particles (liberated external additive particles) are liberated from the surfaces of toner particles. As a result, the following data about the outermost layers of toner particles are obtained:

New toner;

Synchronous external additive particles 98%

Liberated external additive particles 2%

Deteriorated toner;

Synchronous external additive particles 80%

Liberated external additive particles 20%

Observation of electron micrograph showing the sections of toner particles indicates that mother particles of the deteriorated toner have much embedded external additive particles as compared to the new toner particles.

As the degree sphericity of toner particle is increased, the surface energy is reduced and the contact area relative to a member is reduced. Accordingly, the physical adhesive force between the toner and a member being in contact with the toner is lowered. By setting the degree of sphericity of toner to 0.95 or more, the transfer efficiency can be increased so as to contribute to the realization of cleaner-less system. The degree of sphericity of toner is a mean sphericity measured by a measuring device FPIA-2100 available from Sysmex Corporation. The degree of sphericity is obtained from the degree of circularity of a two-dimensional projected image of toner particle (the circumference of a complete circle having the same area as that of the projected image/the circumferential length of the projected image).

Since polymerized toner particles have a sharp particle size distribution compared to pulverized toner particles, all of the polymerized toner particles may be brought uniformly in contact with a charging member during the toner is triboelectrically charged so that the uniform charging amount can be ensured. As a result, the transfer efficiency is increased so as to contribute to the realization of cleaner-less system.

By providing differences in velocity between the photoreceptor and the primary transfer member and/or between the primary transfer member and the secondary transfer member (or the receiving medium) during transfer, a shearing force against the toner is produced, thereby improving the transfer efficiency.

In a development system for conducting a single-component development, toner particles must be uniformly charged and formed into a uniform thin layer by the regulating blade. As external additive particles coating the surfaces of toner particles may be released and embedded, the characteristic of the toner are changed. That is, the characteristic of the toner before deteriorated greatly depends on the external additives while the characteristic of the toner after deteriorated greatly depends on the mother particles. By satisfying the aforementioned expressions as described in the first aspect of the invention, the stable transfer property can be achieved regardless of the repetition of circulation (deterioration) of the toner.

Figure 5:
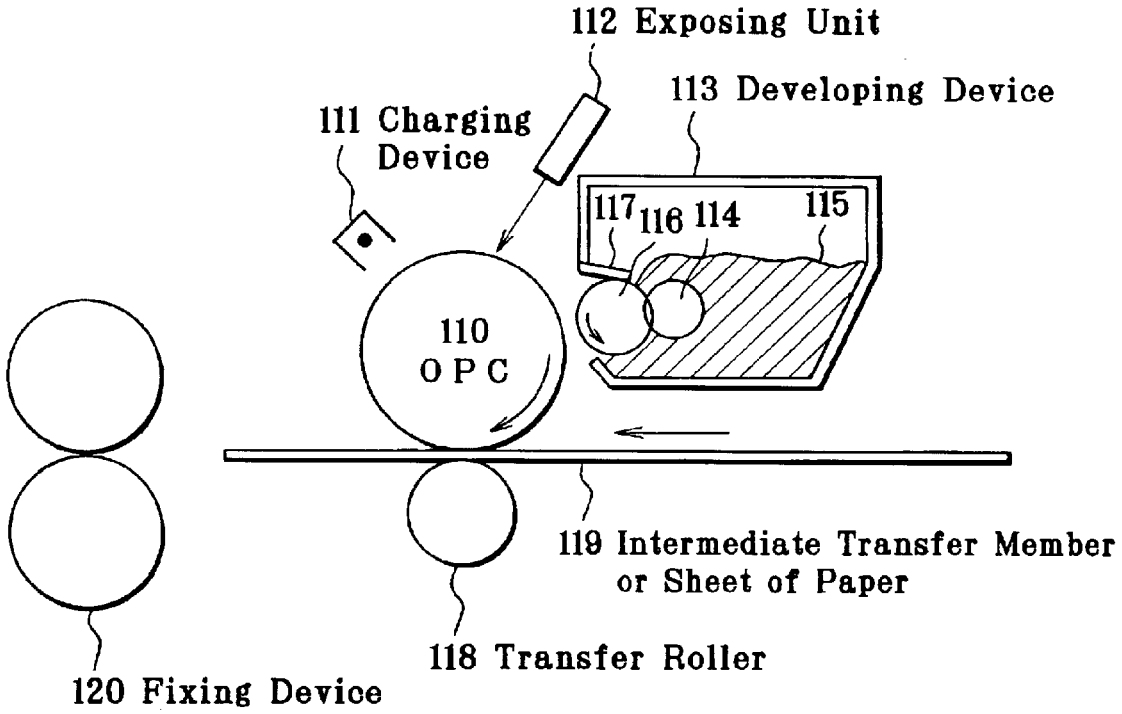
FIG. 5 is a schematic illustration showing a structural example of a monochrome image forming apparatus.

FIG. 5 is a schematic illustration for explaining an example of an image forming apparatus to which the second aspect of the invention is adopted. The example is a structural example of a monochrome image forming apparatus.

Arranged around a photoreceptor (image carrier) 110 are a charging unit 111, an exposing unit 112, a developing device 113, and a transfer roller 118 so that an electrostatic latent image formed on the photoreceptor 110 by the charging unit 111 and the exposing unit 112 is developed by the developing device 113 with a toner. In the developing device 113, a small-particle toner 115 of 10 μm or less in diameter comprising resin mother particles of which surfaces are coated with external additives is agitated by an agitating device (not shown) and is supplied to the surface of a development roller 116 by a supply roller 114. During this, the toner is charged by frictions generated between the rollers. The toner is regulated into a layer having a certain thickness by a regulating blade 117. Also in this regulating process, the toner is triboelectrically charged. The toner is then carried to a nip portion relative to the photoreceptor 110. At the nip portion, charged toner particles are transferred from the development roller to the photoreceptor by the action of a development electric field for development. During this, toner particles consumed for development may account for a several percent of the toner. The rest is returned to the developing device 113 and is supplied to the development roller by the supply roller 114 again for another development. The toner image on the photoreceptor is transferred to an intermediate transfer member or a sheet of paper 119 by the action of a transfer electric field by the transfer roller 118. The transferred image is fixed by a fixing device 120.

As shown in FIG. 2, each small size toner particle of 10 μm or less comprises a mother particle of which surface is coated with external additives for improving the charging property and reducing the adhesive force. When a developing device as shown in FIG. 3 is used, the amount of external additives on the surfaces of toner particles is reduced according to the repetition of circulation as mentioned above. In addition, even a new toner includes liberated mother particles by a several percent. Accordingly, the adhesive force of the toner is increased so that its charging property is deteriorated.

As such a toner of which charging property is deteriorated is used for development, the transfer property is poor when a transfer electric field is applied by the transfer roller 118 due to the small charging amount, thus resulting in generation of residual toner particles. Increase in adhesive force of the mother particles may undesirably cause reverse transfer that toner particles already transferred are reversely transferred when the toner particles arrive in the nip portion again. In a conventional image forming apparatus, residual toner particles after transfer are removed by a cleaner. On the other hand, the transfer efficiency of nearly 100% is necessary to employ the cleaner-less system to an image forming apparatus. This point will be explained with reference to FIG. 6 through FIG. 8.

Figure 6:
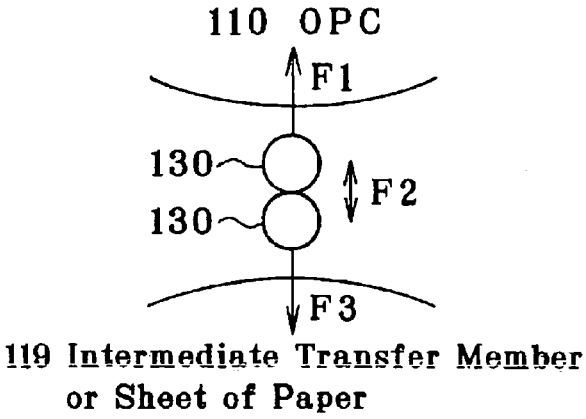
FIG. 6 is a diagram schematically showing the transfer from a photoreceptor to an intermediate transfer member or to a sheet of paper.

FIG. 6 is a diagram schematically showing the transfer from a photoreceptor to an intermediate transfer member or to a sheet of paper.

Normally, development is conducted under a condition that the peripheral velocity of a development roller is set to be higher than the peripheral velocity of a photoreceptor. Therefore, toner particles on the surface of the photoreceptor are piled in one or more stories during deployment. For example, as shown in FIG. 6, a case that the toner particles are piled in two stories during deployment will be explained. It is assumed that the adhesive force (van der Waals forces, image-forces) between the resin mother particle 130 and the photoreceptor 110 is F1, that the adhesive force between the resin mother particles is F2, and that the adhesive force between the resin mother particle and the intermediate transfer member or a sheet of paper is F3. The relation between F1 and F2 is set to satisfy the following expression:

$$F1<F2 \quad (5)$$

When the above expression (5) is satisfied, the relation to between F1 and F3 is set to satisfy the following expression:

$$F1<F3 \quad (6)$$

As such adhesive force satisfying the above expression is applied between the resin mother particle and the intermediate transfer member or the sheet of paper by a transfer electric field, transfer is conducted without story-to-story separation.

Figure 7:
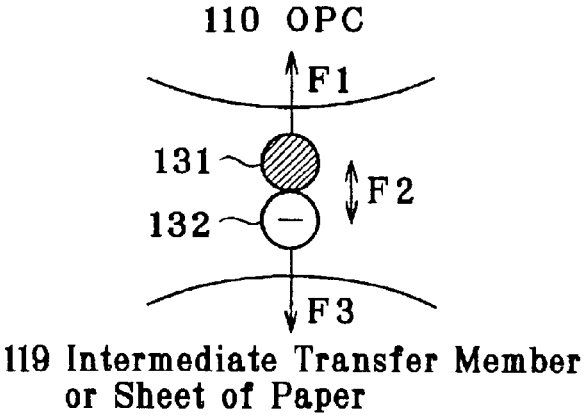
FIG. 7 is a diagram schematically showing a transferring state where the occurrence of story-to-story separation is prevented by the adhesive force between an insufficiently charged toner particle and a normally charged toner particle.

FIG. 7 is a diagram schematically showing a transferring state where the occurrence of story-to-story separation is prevented by the adhesive force between an insufficiently charged toner particle and a normally charged toner particle.

It is assumed that a toner particle 131 is an insufficiently charged toner particle such as a toner particle of which charging property is deteriorated due to the repetition of circulation or a liberated mother particle with reduced external additives and that a toner particle 132 is a normally charged toner particle. When the toner is attracted to the intermediate transfer member or the sheet of paper by the adhesive force F3 between the resin mother particle and the intermediate transfer member or the sheet of paper, the toner particles 131 and 132 are both transferred because the adhesive force F2 between the resin mother particles is larger than the adhesive force F1 between the resin mother particle and the photoreceptor.

Figure 8:
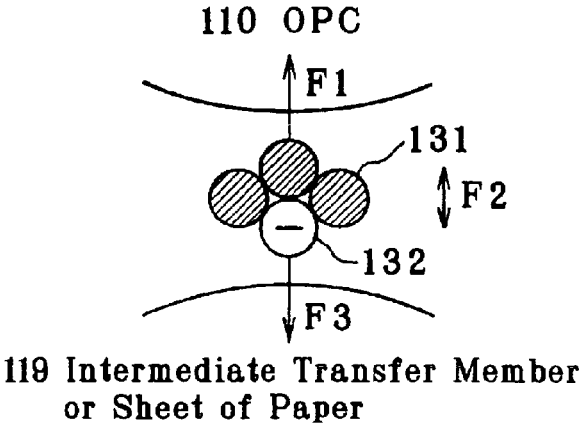
FIG. 8 is a diagram schematically showing a transferring state where insufficiently charged toner particles and a normally charged toner particle adhere to each other as one lump because of adhesive forces therebetween.

FIG. 8 is a diagram schematically showing a transferring state where insufficiently charged toner particles and a normally charged toner particle adhere to each other as one lump because of adhesive forces therebetween.

When toner particles 131 having reduced charging property and a normally charged toner particle 132 adhere to each other as one lump and the toner particles are attracted to the intermediate transfer member or the sheet of paper by the adhesive force F3 between the resin mother particle and the intermediate transfer member or the sheet of paper, the toner particles 131 and 132 are transferred as the lump because the adhesive force F2 between the toner particles is larger than the adhesive force F1 between the resin mother particles and the photoreceptor.

By setting the adhesive force between the resin mother particles to be larger than the adhesive force between the photoreceptor and the resin mother particle, the generation of residual toner particles due to insufficiently charged toner particles can be prevented as mentioned above. It should be understood that toner particles which are sufficiently coated with external additives and are thus sufficiently charged are well transferred by the action of a transfer electric field without generating residual toner particles.

As the photoreceptor for setting the adhesive force between the resin mother particle and the photoreceptor to be smaller than the adhesive force between the resin mother particles, any one of the examples (I), (II), (III) of photoreceptors as described with regard to the first aspect of the invention can be employed.

In Example 2, as the photoreceptor, one of the above photoreceptors (I), (II), and (III) is employed. As the belt material of the intermediate transfer member, urethane, polyester, polycarbonate, PET (PET may contain a fluorine-containing group or a silicon-containing group), or the like is used. New toner particles and toner particles after deteriorated due to repetition of circulations are compressed to be formed into tablets, respectively. These tablets are pressed against and slid on the photoreceptor or a sheet made of the same material of the photoreceptor to obtain a coefficient of friction. The tablets are pressed against and slid on each other to obtain a coefficient of friction. The coefficients of friction are measured. Example 2 will be described.

EXAMPLE 2

A toner X is compressed at 1000–5000 kgf/cm$^2$ into tablets (By compressing the toner at high pressure, the adhesive force of the toner dominantly depends on the effect of the mother particle). One of the tablets is pressed against a sheet made of the same surface material as that of the image carrier at 20 gf/cm$^2$–400 gf/cm$^2$ and is slid on the sheet (fixed) to obtain a coefficient of friction. One of the tablets is fixed and another tablet is sled relative to the fixed tablet in the same manner to obtain a coefficient of friction. By using the toner satisfying that the coefficient of friction between the tablet and the sheet is set to be smaller than the coefficient of friction between the tablets, the transfer efficiencies are measured, with the results that the transfer efficiency of 99.6–100% is achieved in the initial state and that the transfer efficiency of 99.3–99.7% is achieved even after deteriorated.

By using a PT-1000 (available from Yokogawa Electric Corporation) and according to the particle analyzer method, the toner in the initial state is measured. As a result, the data about the outermost layers of toner particles indicating 5% liberated mother particles (based on the number) is obtained.

Though the above example is explained as regard to the monochrome image forming apparatus, the present invention can be adopted to a case that a tandem type image forming apparatus having a plurality of image forming units with respective photoreceptors is used for monochrome printing.

It is preferable to provide differences in velocity during transfer so that a shearing force acts on the toner in order to reduce the adhesive force between the photoreceptor and mother particles.

Generally, a toner comprises mother particles of which main material is a resin such as polyester, styrene, and acryl and external additives coating the surfaces of the mother particles. The external additives have a function of reducing the adhesive force between the toner and a member of the apparatus being in contact with the toner and a function of charging the toner. To achieve the realization of an image forming apparatus without cleaner mechanism by achieving the transfer efficiency of nearly 100%, the transfer efficiency of liberated mother particles of which surfaces are exposed and which have thus large adhesive force relative to the member being in contact with the particles and have reduced charging property (the charging amount is nearly 0) and the transfer efficiency of deteriorated toner particles must be taken into consideration.

For this, in the second aspect of the invention, the adhesive force between resin mother particles, composing of a toner, is set to be larger than the adhesive force between the image carrier and the resin mother particle so that toner particles, which are hardly transferred by electric forces, are transferred by being attracted to surrounding toner particles by the adhesive force therebetween. Therefore, high transfer efficiency and stable transferring characteristic can be achieved regardless of the repetition of circulation (deterioration) of the toner.

The third aspect of the invention is similar to the second aspect of the invention. Assuming that the adhesive force between the resin mother particle 130 and the photoreceptor 110 is F1, that the adhesive force between the resin mother particles is F2, and that the adhesive force between the resin mother particle and the intermediate transfer member or a sheet of paper is F3 in FIG. 6, the different point of the third aspect from the second aspect is that the aforementioned expressions (5), (6) are satisfied at the same time.

In FIG. 6, as the expression (5) is satisfied, story-to-story separation of the toner is never caused even when some resin mother particles are insufficiently charged and a force attracting the resin mother particles to the photoreceptor 110 acts. As an adhesive force satisfying the expression (6) is applied between the resin mother particle and the intermediate transfer member by the action of a transfer electric field, the mother particle is transferred to the intermediate transfer member. Accordingly, generation of residual toner particles on the photoreceptor is never caused theoretically.

In FIG. 7, it is assumed that a toner particle 131 is a deteriorated toner particle or a liberated mother particle of which the amount of external additives is reduced and the charging property is deteriorated and which is thus insufficiently charged and a toner particle 132 is a normally charged toner particle. When the toner are attracted to the intermediate transfer member by the adhesive force F3 between the resin mother particle and the intermediate transfer member, the toner particles 131, 132 are transferred together without occurrence of story-to-story separation because the adhesive force F2 between the resin mother particles thereof is larger than the adhesive force F1 between the resin mother particle and the photoreceptor and the adhesive force F3 is larger than the F1.

In FIG. 8, when toner particles 131 having reduced charging property and a normally charged toner particle 132 adhere to each other as one lump and the toner particles are attracted to the intermediate transfer member by the adhesive force F3 between the resin mother particle and the intermediate transfer member, the toner particles 131 and 132 are transferred as the lump because the adhesive force F2 between the toner particles is larger than the adhesive force F1 between the resin mother particles and the photoreceptor and the adhesive force F3 is larger than the adhesive force F1.

By setting the adhesive force between the resin mother particle and the photoreceptor to be smaller than the adhesive force between the resin mother particles and the adhesive force between the resin mother particle and the intermediate transfer member, the occurrence of reverse transfer due to insufficiently charged toner particles and toner particles having increased adhesive force can be prevented as mentioned above. It should be understood that toner particles which are sufficiently coated with external additives and are thus sufficiently charged are well transferred by the action of a transfer electric field without causing reverse transfer.

As the photoreceptor for setting the adhesive force between the resin mother particle and the photoreceptor to be smaller than the adhesive force between the resin mother particles and the adhesive force between the resin mother particle and the intermediate transfer member, any one of the examples (I), (II), (III) of photoreceptors as described with regard to the first aspect and the second aspect of the invention can be employed.

In Example 3, as the photoreceptor, one of the above photoreceptors (I), (II), and (III) is employed. As the belt material of the intermediate transfer member, urethane, polyester, polycarbonate, PET (PET may contain a fluorine-containing group or a silicon-containing group), or the like is used. New toner particles and toner particles after deteriorated due to repetition of circulations are compressed to be formed into tablets, respectively. These tablets are pressed against and slid on the photoreceptor or a sheet made of the same material of the photoreceptor, the tablets are pressed against and slid on each other, and the tablets are pressed against and slid on the intermediate transfer member to obtain a coefficient of friction. The coefficients of friction are measured. Example 3 will be described.

EXAMPLE 3

A toner X is compressed at 1000–5000 kgf/cm$^2$ into tablets (By compressing the toner at high pressure, the adhesive force of the toner dominantly depends on the effect of the mother particle). One of the tablets is pressed against a sheet made of the same surface material as that of the image carrier at 20 gf/cm$^2$–400 gf/cm$^2$ and is slid on the sheet (fixed) to obtain a coefficient of friction. One of the tablets is fixed and another tablet is sled relative to the fixed tablet in the same manner to obtain a coefficient of friction. One of the tablets is pressed against the intermediate transfer member at 20 gf/cm$^2$–400 gf/cm$^2$ and is slid on the intermediate transfer member to obtain a coefficient of friction. By using the toner satisfying that the coefficient of friction between the tablet and the sheet is set to be smaller than both the coefficient of friction between the tablets and the coefficient of friction between the tablet and the intermediate transfer member, the transfer efficiencies are measured, with the results that the transfer efficiency of 99.6–100% is achieved in the initial state and that the transfer efficiency of 99.3–99.7% is achieved even after deteriorated.

Though the above example is explained as regard to the monochrome image forming apparatus, the present invention can be adopted to a case that a tandem type image forming apparatus having a plurality of image forming units with respective photoreceptors is used for monochrome printing.

In order to reduce the adhesive force between the photoreceptor and mother particles, it is preferable to provide differences in velocity during transfer so that a shearing force acts on the toner to facilitate the toner to be released from the photoreceptor.

In the third aspect of the invention, the adhesive force between a resin mother particle and the image carrier is set to be smaller than both the adhesive force between resin mother particles and the adhesive force between a resin mother particle and the intermediate transfer member. Therefore, even when there are toner particles which are hardly transferred by electric forces (because the charging amount of the toner particles is insufficient) and mother particles of which surfaces are exposed and thus have increased adhesive force relative to the photoreceptor, such particles are facilitated to be transferred by the adhesive force because the adhesive force between the resin mother particles and the adhesive force relative to the intermediate transfer member are both larger than the adhesive force relative to the photoreceptor.

Figure 9:
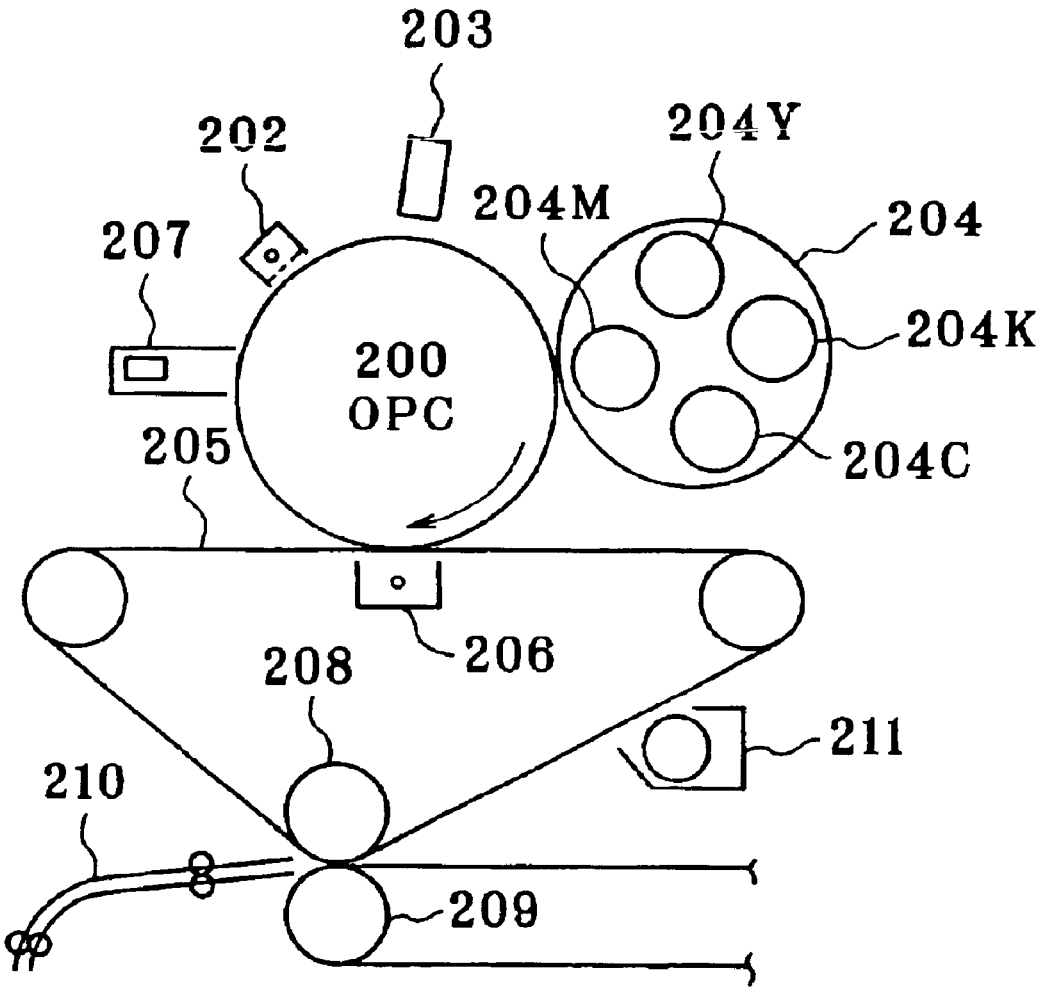
FIG. 9 is an illustration showing a structural example of an image forming apparatus to which the present invention is adopted.

FIG. 9 is an illustration showing a structural example of an image forming apparatus to which the fourth through eighth aspects of the invention are adopted and in which multi-color images are superposed at an intermediate transfer member.

Arranged around a photoreceptor 200 are a charging unit 202, an exposing unit 203, and a rotary-type developing device 204 so that a toner image developed by the rotary-type developing device 204 is transferred to an intermediate transfer member 205 with a transfer electric field created by a transfer charging device 206 which is disposed opposite to the photoreceptor 200 via the intermediate transfer member 205. Residual potential remaining on the photoreceptor after transfer is removed by a charge removing unit 207 so that another electrostatic latent image is formed and developed with a toner again. The rotary-type developing device 204 has an yellow developing unit 204Y, a magenta developing unit 204M, a cyan developing unit 204C, and a black developing unit 204K. The developing units for respective colors are brought to a developing position one after another just like a revolver to intermittently develop images. The respective color toner images are superposed on each other at the intermediate transfer member 205. The multi-color image on the intermediate transfer member is transferred to a receiving medium 210 by the action of a transfer electric field created by a secondary transfer roller 209 which is disposed opposite to a backup roller 208 via the intermediate transfer member. Residual toner particles on the intermediate transfer member are removed by a cleaner 211.

As shown in FIG. 2, each small size toner particle of 10 μm or less comprises a mother particle of which surface is coated with external additives for improving the charging property and reducing the adhesive force. When a developing device as shown in FIG. 3 is used, the amount of external additives on the surfaces of toner particles is reduced according to the repetition of circulation as mentioned above. In addition, even a new toner includes liberated mother particles by a several percent. Accordingly, the adhesive force of the toner is increased so that its charging property is deteriorated. As such a toner of which charging property is deteriorated is used for development, the transfer efficiency is poor when a transfer electric field is applied by the transfer roller due to the small charging amount, thus resulting in generation of residual toner particles. Increase in adhesive force of the toner relative to the photoreceptor may undesirably cause color-to-color separation when multi-color images are superposed at the intermediate transfer member and may cause reverse transfer of such particles from intermediate transfer member to the photoreceptor in the next cycle for superposition of multi-color images.

The object of the fourth aspect of the invention is to achieve the transfer efficiency of nearly 100% to prevent the occurrence of the aforementioned problems, thereby realizing a cleaner-less system. The means for resolving the object will be explained below.

Figure 10:
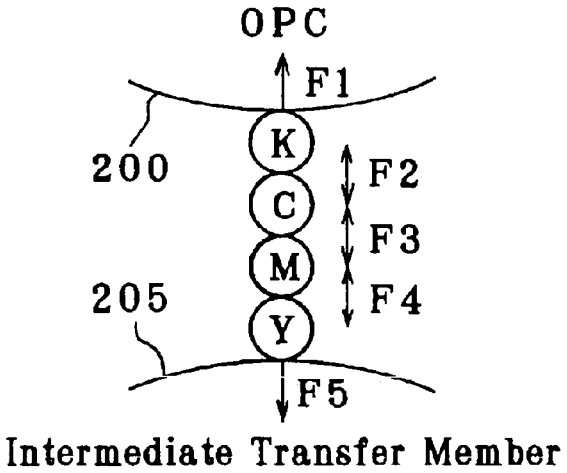
FIG. 10 is a diagram schematically showing the superposition of multi-color images on an intermediate transfer member.

FIG. 10 is a diagram schematically showing the superposition of multi-color images on an intermediate transfer member.

As shown in FIG. 10, it is assumed that images with toners Y, M, C, K are transferred from the photoreceptor to the intermediate transfer member in this order, that the adhesive force between resin mother particles of the toner K and the toner C is F2, that the adhesive force between resin mother particles of the toner C and the toner M is F3, that the adhesive force between resin mother particles of the toner M and the toner Y is F4, that the adhesive force between a resin mother particle of any one of the toners and the photoreceptor is F1, and that the adhesive force between a resin mother particle of any one of the toners and the intermediate transfer member is F5. The relation among F1, F2, F3, and F4 is set to satisfy the following expression:

$$F1<F2,\ F3,\ F4 \tag{7}$$

When the above expression (7) is satisfied, the relation between F1 and F5 is set to satisfy the following expression:

$$F1<F5 \tag{8}$$

By satisfying the above expressions, images with such toners are transferred to the intermediate transfer member without color-to-color separation. The occurrence of reverse transfer from the intermediate transfer member to the photoreceptor is also prevented. By setting the transfer electric field, the surface roughness of the photoreceptor and the surface roughness of the intermediate transfer member, and the like, the expression (8) can be easily satisfied.

In addition to the setting of the adhesive forces between particular unicolor toners according to the expression (7), assuming that the adhesive force between particles of the toner K and any one of the other toners is Fk, that the adhesive force between particles of the toner C and any one of the other toners is Fc, that the adhesive force between particles of the toner M and any one of the other toners is Fm, and that the adhesive force between particles of the toner Y and any one of the other toners is Fy, the relation among F1, Fk, Fc, Fm, and Fy is set to satisfy the following expression:

$$F1<Fk, Fc, Fm, Fy \quad (9)$$

As the expression (8) is satisfied when the expression (9) is satisfied, occurrence of story-to-story separation between such unicolor toners during transfer is prevented and reverse transfer from the intermediate transfer member to the photoreceptor is also prevented.

By setting the adhesive force between the resin mother particles of toners of different colors to be larger than the adhesive force between the photoreceptor and the resin mother particle of any one of the unicolor toners, the generation of residual toner particles, color-to-color separation, and the reverse transfer due to toner particles which are deteriorated and thus have reduced amount of external additives and/or liberated mother particles can be prevented as mentioned above. It should be understood that toner particles which are sufficiently coated with external additives and are thus sufficiently charged are securely transferred by the action of a transfer electric field without causing such problems.

Figure 11:
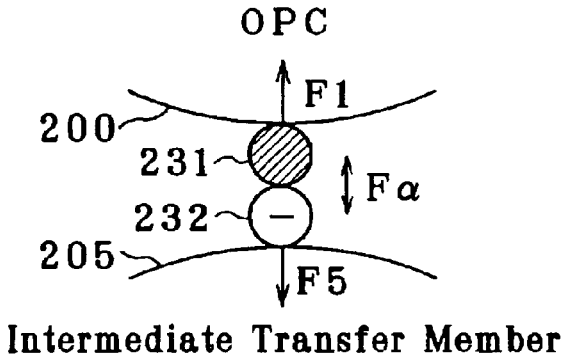
FIG. 11 is a diagram schematically showing a transferring state where no story-to-story separation is caused because of the adhesive force between an insufficiently charged toner particle and a normally charged toner particle of a different color.

FIG. 11 is a diagram schematically showing a transferring state where no story-to-story separation is caused because of the adhesive force between an insufficiently charged toner particle and a normally charged toner particle of a different color.

A toner particle 231 of some color is a toner particle which is deteriorated or a liberated mother particle so that the amount of external additives thereof is reduced and the charging property thereof is deteriorated. Accordingly, the toner particle 231 is insufficiently charged, while a toner particle 232 of a color different from the toner particle 231 is normally charged. The toner particle 232 is normally transferred by the adhesive force F5 between the mother particle and the intermediate transfer member. When the toner particle 231 is in contact with the toner particle 232 in the next cycle, the insufficiently charged toner particle 231 is transferred without occurrence of color-to-color separation between the toners 231, 232 because the adhesive force Fα between resin mother particles of toners of different colors is larger than the adhesive force F1 (on the condition that F1<F5) between the resin mother particle and the photoreceptor.

Figure 12:
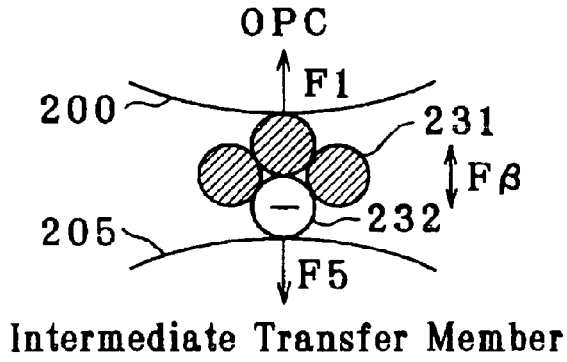
FIG. 12 is a diagram schematically showing a state that insufficiently charged toner particles of one color are transferred as a lump by the adhesive force between the insufficiently charged toner particles and a normally charged toner particle of another color.

FIG. 12 is a diagram schematically showing a state that insufficiently charged toner particles of one color are transferred as a lump by the adhesive force between the insufficiently charged toner particles and a normally charged toner particle of another color.

Toner particles 231 are toner particles which are deteriorated or liberated mother particles so that the amount of external additives thereof is reduced and the charging property thereof is deteriorated. Accordingly, the toner particles 231 are insufficiently charged, while a toner particle 232 of another color is normally charged. The toner particle 232 is normally transferred by the adhesive force F5 between the mother particle and the intermediate transfer member. When the toner particles 231 are in contact with the toner particle 232 in the next cycle, the insufficiently charged toner particles 231 are transferred as a lump without occurrence of color-to-color separation between the toners 231, 232 because the adhesive force Fβ between resin mother particles formed in a lump and the mother particle of normally charged toner is larger than the adhesive force F1 (on the condition that F1<F5) between the resin mother particle and the photoreceptor.

By setting the adhesive force between the resin mother particles of toners of different colors to be larger than the adhesive force between the resin mother particle and the photoreceptor, the generation of residual toner particles due to insufficiently charged toner particles can be prevented as mentioned above. It should be understood that toner particles which are sufficiently coated with external additives and are thus sufficiently charged are well transferred by the action of a transfer electric field without generating residual toner particles.

As the photoreceptor for setting the adhesive force between the resin mother particle of a toner of any color and the photoreceptor to be smaller than the adhesive force between the resin mother particles of toners of different colors, any one of the examples (I), (II), (III) of photoreceptors as described with regard to the first through third aspects of the invention can be employed.

In Example 4, as the photoreceptor, one of the above photoreceptors (I), (II), and (III) is employed. As the belt material of the intermediate transfer member, urethane, polyester, polycarbonate, PET (PET may contain a fluorine-containing group or a silicon-containing group), or the like is used. New toner particles and toner particles after deteriorated due to repetition of circulations are compressed to be formed into tablets, respectively. These tablets are pressed against and slid on the photoreceptor or a sheet made of the same material of the photoreceptor and the tablets are pressed against and slid on each other to obtain a coefficient of friction. The coefficients of friction are measured. Example 4 will be described.

EXAMPLE 4

Toners X of two colors (Xa, Xb) are compressed at 1000–5000 kgf/cm$^2$ into tablets (By compressing the toner at high pressure, the adhesive force of the toner dominantly depends on the effect of the mother particle). One of the tablets of each toner is pressed against a sheet made of the same surface material as that of the image carrier at 20 gf/cm$^2$–400 gf/cm$^2$ and is slid on the sheet (fixed) to obtain coefficients of friction $\mu$a and $\mu$b. One tablet of each toner is fixed and another tablet is sled relative to the fixed tablet in the same manner to obtain a coefficient of friction. By using the toners satisfying that the coefficients of friction $\mu$a, $\mu$b between the tablets of the respective toners and the sheet are both set to be smaller than the coefficients of friction between the tablets of the respective toners, the transfer efficiencies of multi-color images are measured, with the results that the transfer efficiency of 99.8–100% is achieved in the initial state and that the transfer efficiency of 99.4–99.8% is achieved even after deteriorated.

Though the above example is explained as regard to the image forming apparatus in which the rotary-type developing device is used and superposition of multi-color images is conducted on the intermediate transfer member by using only one photoreceptor, the present invention can be adopted to a tandem type image forming apparatus, provided with a plurality of image forming units with respective photoreceptors, in which multi-color images are transferred to an intermediate transfer member one after another.

It is preferable to provide differences in velocity between the intermediate transfer member and the photoreceptor so that a shearing force acts on a toner in order to reduce the adhesive force between the photoreceptor and mother particles of the toner.

As mentioned above, a toner comprises mother particles of which main material is a resin such as polyester, styrene, and acryl and external additives coating the surfaces of the mother particles. The external additives have a function of reducing the adhesive force between the toner and a member of the apparatus being in contact with the toner and a function of charging the toner. To achieve the realization of an image forming apparatus without cleaner mechanism by achieving the transfer efficiency of nearly 100%, the transfer efficiency of liberated mother particles of which surfaces are exposed and which have thus large adhesive force relative to the member being in contact with the particles and have reduced charging property (the charging amount is nearly 0) and the transfer efficiency of deteriorated toner particles must be taken into consideration.

For this, in the fourth aspect of the invention, the adhesive force between resin mother particles of any different colors is set to be larger than the adhesive force between the resin mother particle of any color and the photoreceptor so that toner particles, which are hardly transferred by electric forces, are transferred by being attracted to surrounding toner particles because of the adhesive force therebetween, thereby preventing separation between toners of different colors during transfer of multi-color images and thus preventing the reduction in transfer efficiency. Therefore, high transfer efficiency and stable transferring characteristic can be achieved regardless of the repetition of circulation (deterioration) of the toner.

The fifth aspect of the invention is similar to the fourth aspect of the invention, except that, in FIG. 10, the adhesive force between a resin mother particle and an image carrier is set to be smaller than the adhesive force between resin mother particles of at least two toners of different colors and the adhesive force between a resin mother particle and an intermediate transfer member.

In FIG. 10, assuming that images with toners Y, M, C, K are transferred from the photoreceptor to the intermediate transfer member in this order, that the adhesive force between a resin mother particle of the toner of any color and the photoreceptor is F1, that the adhesive force between resin mother particles of the toner K and the toner C is F2, that the adhesive force between resin mother particles of the toner C and the toner M is F3, that the adhesive force between resin mother particles of the toner M and the toner Y is F4, and that the adhesive force between a resin mother particle of any one of the toners and the intermediate transfer member is F5, the expression (7) and the expression (8) are satisfied at the same time. As the expression (7) is satisfied, story-to-story separation of any toner is never caused even when some resin mother particles are insufficiently charged and a force attracting the resin mother particles to the photoreceptor acts. As an adhesive force satisfying the expression (8) is applied between a resin mother particle and the intermediate transfer member by the action of a transfer electric field, the mother particle is transferred to the intermediate transfer member. Accordingly, generation of residual toner particles on the photoreceptor and reverse transfer are never caused theoretically.

In addition to the setting of the adhesive forces between particular unicolor toners according to the expression (7), assuming that the adhesive force between particles of the toner K and any one of the other toners is Fk, that the adhesive force between particles of the toner C and any one of the other toners is Fc, that the adhesive force between particles of the toner M and any one of the other toners is Fm, and that the adhesive force between particles of the toner Y and any one of the other toners is Fy, the expression (9) is satisfied. As the expressions (8), (9) are satisfied, occurrence of story-to-story separation between such unicolor toners during transfer is prevented and reverse transfer from the intermediate transfer member to the photoreceptor is also prevented, thereby preventing the generation of residual toner particles and reverse transfer due to toner particles which are deteriorated and have thus reduced amount of external additives thereof and liberated mother particles. It should be understood that toner particles which are sufficiently coated with external additives and are thus sufficiently charged are securely transferred by the action of a transfer electric field without causing problems.

In FIG. 11, a toner particle 231 of one color is a deteriorated toner particle or a liberated mother particle so that the amounts of external additives thereof are reduced and the charging property thereof is deteriorated. Accordingly, the toner particle 231 is insufficiently charged, while a toner particle 232 of a color different from the toner particle 231 is normally charged. The toner particle 232 is normally transferred by the adhesive force F5 between the mother particle and the intermediate transfer member. When lump of the toner particles 231 is in contact with the toner particle 232 in the next cycle, the insufficiently charged toner particle 231 is transferred without occurrence of color-to-color separation because the adhesive force Fα between resin mother particles of toners of different colors is larger than the adhesive force F1 between the resin mother particle and the photoreceptor and F5 is larger than F1.

In FIG. 12, toner particles 231 are deteriorated toner particles and/or liberated mother particles so that the amount of external additives thereof is reduced and the charging property thereof is deteriorated. Accordingly, the toner particles 231 are insufficiently charged, while a toner particle 232 of another color is normally charged. The toner particle 232 is normally transferred by the adhesive force F5 between the mother particle and the intermediate transfer member. When the toner particle 231 is in contact with the toner particle 232 in the next cycle, the insufficiently charged toner particles 231 are transferred as a lump without occurrence of color-to-color separation between the toners 231, 232 because the adhesive force fβ between resin mother particles formed in a lump and the mother particle of normally charged toner is larger than the adhesive force F1 between the resin mother particle and the photoreceptor and F5 is larger than F1.

By setting the adhesive force between the resin mother particle and the image carrier to be smaller than the adhesive force between the resin mother particles of at least two toners of different colors, the generation of residual toner particles and reverse transfer due to insufficiently charged toner particles having increased adhesive force can be prevented as mentioned above. It should be understood that toner particles which are sufficiently coated with external additives and are thus sufficiently charged are well transferred by the action of a transfer electric field with neither generation of residual toner particles nor reverse transfer.

As the photoreceptor for setting the adhesive force between the resin mother particle of a toner of any color and the image carrier to be smaller than the adhesive force between the resin mother particles of at least two toners of different colors, any one of the examples (I), (II), (III) of photoreceptors as described with regard to the first through fourth aspects of the invention can be employed.

In Example 5, as the photoreceptor, one of the above photoreceptors (I), (II), and (III) is employed. As the belt material of the intermediate transfer member, urethane, polyester, polycarbonate, PET (PET may contain a fluorine-containing group or a silicon-containing group), or the like is used. New toner particles and toner particles after deteriorated due to repetition of circulations are compressed to be formed into tablets, respectively. These tablets are pressed against and slid on the photoreceptor or a sheet made of the same material of the photoreceptor and the tablets are pressed against and slid on each other to obtain a coefficient of friction. The coefficients of friction are measured. Example 5 will be described.

EXAMPLE 5

Toners X of two colors (Xa, Xb) are compressed at 1000–5000 kgf/cm$^2$ into tablets (By compressing the toner at high pressure, the adhesive force of the toner dominantly depends on the effect of the mother particle). One of the tablets of each toner is pressed against a sheet made of the same surface material as that of the image carrier at 20 gf/cm$^2$–400 gf/cm$^2$ and is slid on the sheet (fixed) to obtain coefficients of friction $\mu$a and $\mu$b. One tablet of each toner is fixed and another tablet is sled relative to the fixed tablet in the same manner to obtain a coefficient of friction. One of the tablets of each toner is pressed against an intermediate transfer member at 20 gf/cm$^2$–400 gf/cm$^2$ and is slid on the intermediate transfer member to obtain a coefficient of friction. By using the toners satisfying that the coefficients of friction $\mu$a, $\mu$b between the tablets of the respective toners and the sheet are both set to be smaller than the coefficients of friction between the tablets of the respective toners and the coefficients of friction between the tablets of the respective toners and the intermediate transfer member, the transfer efficiencies of multi-color images are measured, with the results that the transfer efficiency of 99.8–100% is achieved in the initial state and that the transfer efficiency of 99.4–99.8% is achieved even after deteriorated.

Though the above example is explained as regard to the image forming apparatus in which the rotary-type developing device is used and superposition of multi-color images is conducted on the intermediate transfer member by using only one photoreceptor, the present invention can be adopted to a tandem type image forming apparatus, provided with a plurality of image forming units with respective photoreceptors, in which multi-color images are transferred to an intermediate transfer member one after another.

It is preferable to provide differences in velocity between the intermediate transfer member and the photoreceptor so that a shearing force acts on a toner in order to reduce the adhesive force between the photoreceptor and mother particles of the toner.

In the fifth aspect of the present invention, by setting the adhesive force between resin mother particle and the image carrier to be smaller than the adhesive force between the resin mother particles of at least two toners of different colors and the adhesive force between resin mother particle and the intermediate transfer member, toner particles, which are hardly transferred by electric forces, are transferred by being attracted to surrounding toner particles by the adhesive force therebetween, thereby preventing separation between toners of different colors during transfer of multi-color images (the thickness of toner layer is large and acting electrical force is small) and thus preventing the reduction in transfer efficiency (since the acting electrical force is small and toner particles of which charging amount is nearly 0 exist in toners of different colors, such toner particles are not transferred during transfer of multi-color images). Therefore, high transfer efficiency and stable transfer property can be achieved regardless of the repetition of circulation (deterioration) of the toner.

Description will now be made as regard to the sixth aspect of the invention directed to prevent the occurrence of story-to-story separation during transfer from an intermediate transfer member to a receiving medium (a sheet of paper).

As toner particles of which the amount of external additives is reduced and/or the charging property is deteriorated such as librated mother particles, are used for development, the transfer property is poor when a transfer electric field is applied by the secondary transfer roller 209 due to the small charging amount in FIG. 9. On the intermediate transfer member, toner particles of different colors adhere to be piled in the form of multi-story. As the multi-story toner particles partially include insufficiently charged toner particles, story-to-story separation should be caused between normally charged toner particles and the insufficiently charged toner particles during transfer.

The object of the sixth aspect of the invention is to prevent the occurrence of story-to-story separation during transfer from an intermediate transfer member to a receiving medium (a sheet of paper), thereby realizing a cleaner-less mechanism of the intermediate transfer member. This point will be explained below.

Figure 13:
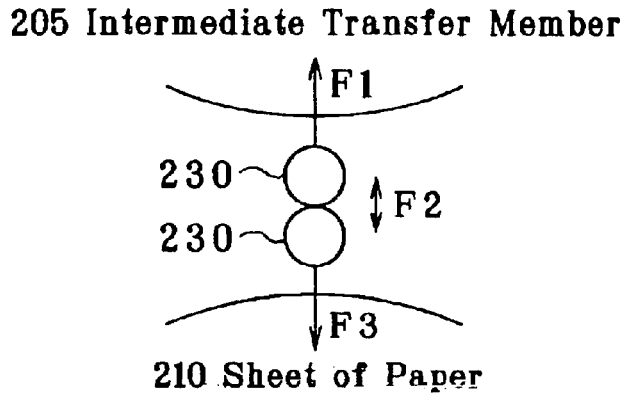
FIG. 13 is a diagram schematically showing the transfer from an intermediate transfer member to a sheet of paper.

FIG. 13 is a diagram schematically showing the transfer from an intermediate transfer member to a sheet of paper.

Normally, toner particles on the surface of the intermediate transfer member are piled in a plurality of stories. For facilitating the explanation, as shown in FIG. 13, it is assumed that the toner particles are piled in two stories. It is assumed that the adhesive force (van der Waals forces, image-forces) between resin mother particles 230 and an intermediate transfer member 205 is F1, that the adhesive force between the resin mother particles is F2, and that the adhesive force between the resin mother particles and a sheet of paper 210 is F3. The relation between F1 and F2 is set to satisfy the following expression:

$$F1<F2 \tag{10}$$

When the above expression (10) is satisfied, the relation between F1 and F3 is set to satisfy the following expression:

$$F1<F3 \tag{11}$$

As such adhesive force satisfying the above expression is applied between the resin mother particles and the sheet of paper by a transfer electric field, the toner particles are transferred without story-to-story separation.

Figure 14:
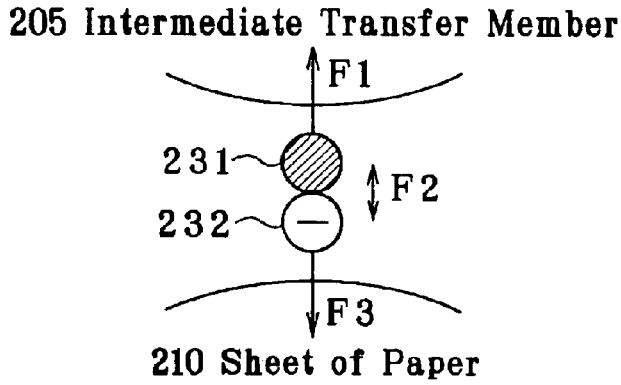
FIG. 14 is a diagram schematically showing a transferring state where no story-to-story separation is caused because of the adhesive force between an insufficiently charged toner particle and a normally charged toner particle.

FIG. 14 is a diagram schematically showing a transferring state where no story-to-story separation is caused because of the adhesive force between an insufficiently charged toner particle and a normally charged toner particle.

It is assumed that a toner particle 231 is an insufficiently charged toner particle such as a toner particle of which charging property is deteriorated due to the repetition of circulation or a liberated mother particle with reduced external additives and that a toner particle 232 is a normally charged toner particle. Assuming that the adhesive forces between the toner particles and between the toner particles and the respective members are the same as those of the toner particles in FIG. 13 and the expressions (10) and (11) are satisfied, when the toner particles are attracted to the sheet of paper 210 by the adhesive force F3, the insufficiently charged toner particle 231 is also transferred by being attracted to the normally charged toner particle 232 because the adhesive force F2 between the toner particles is larger than the adhesive force F1 between the insufficiently charged toner particle 231 and the intermediate transfer member.

Figure 15:
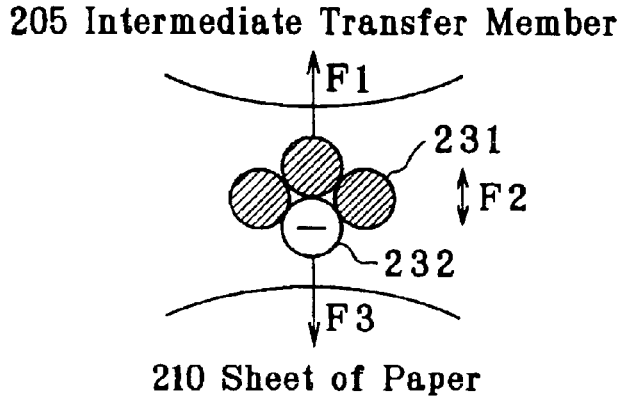
FIG. 15 is a diagram schematically showing a state that insufficiently charged toner particles and a normally charged toner are transferred as a lump by the adhesive force among the toner particles.

FIG. 15 is a diagram schematically showing a state that insufficiently charged toner particles and a normally charged toner particle are transferred as a lump by the adhesive force among the toner particles.

Insufficiently charged toner particles 231 and a normally toner particle 232 adhere to each other as a lump. Assuming that the adhesive forces between the toner particles and between the toner particles and the respective members are the same as those of the toner particles in FIG. 13 and the expressions (10) and (11) are satisfied, when the toner particles are attracted to the sheet of paper 210 by the adhesive force F3 between the resin mother particle and the sheet of paper 210, the insufficiently charged toner particles 231 are also transferred as a part of lump including the normally charged toner 232 by being attracted to the normally charged toner particle 232 because the adhesive force F2 among the toner particles is larger than the adhesive force F1 between the resin mother particles and the intermediate transfer member.

By setting the adhesive force among the resin mother particles to be larger than the adhesive force between the resin mother particles and the intermediate transfer member, the occurrence of story-to-story separation due to insufficiently charged toner particles can be prevented as mentioned above. It should be understood that toner particles which are sufficiently coated with external additives and are thus sufficiently charged are well transferred by the action of a transfer electric field without causing story-to-story separation.

As the intermediate transfer member for setting the adhesive force between the resin mother particle and the intermediate transfer member to be smaller than the adhesive force among the resin mother particles, examples include an intermediate transfer member of which belt is made of urethane, polyester, polycarbonate, PET, or the like. It should be noted that PET may contain a fluorine-containing group or a silicon-containing group.

In Example 6, new toner particles and toner particles after deteriorated due to repetition of circulations are compressed to be formed into tablets, respectively. These tablets are pressed against and slid on the intermediate transfer member or a sheet made of the same material of the intermediate transfer member and the tablets are pressed against and slid on each other to obtain a coefficient of friction. The coefficients of friction are measured. Example 6 will be described.

EXAMPLE 6

A toner X is compressed at 1000–5000 kgf/cm$^2$ into tablets (By compressing the toner at high pressure, the adhesive force of the toner dominantly depends on the effect of the mother particle). One of the tablets is pressed against a sheet made of the same surface material as that of the intermediate transfer member at 20 gf/cm$^2$–400 gf/cm$^2$ and is slid on the sheet (fixed) to obtain a coefficient of friction. One of the tablets is fixed and another tablet is sled relative to the fixed tablet in the same manner to obtain a coefficient of friction. By using the toner satisfying that the coefficient of friction between the tablet and the sheet is set to be smaller than the coefficient of friction between the tablets, the transfer efficiencies are measured, with the results that the transfer efficiency of 99.6–100% is achieved in the initial state and that the transfer efficiency of 99.3–99.7% is achieved even after deteriorated.

By using a PT-1000 (available from Yokogawa Electric Corporation) and according to the particle analyzer method, the toner in the initial state is measured. As a result, the data about the outermost layers of toner particles indicating 5% liberated mother particles (based on the number) is obtained.

Though the above example is explained as regard to the image forming apparatus in which the rotary-type developing device is used and only one photoreceptor is provided, the sixth aspect of the invention can be adopted to a tandem type image forming apparatus, provided with a plurality of image forming units with respective photoreceptors.

In the sixth aspect of the invention, the adhesive force between resin mother particles composing a toner is set to be larger than the adhesive force between a resin mother particle and the intermediate transfer member, whereby toner particles which are hardly transferred by electric forces can be transferred by being attracted to surrounding toner particles. Therefore, high transfer efficiency and stable transfer property can be achieved regardless of the repetition of circulation (deterioration) of the toner, thereby enabling the realization of a cleaner-less mechanism of the intermediate transfer member.

Description will now be made as regard to the seventh aspect of the invention directed to prevent the creation of defects of transferred colorant.

Figure 16:
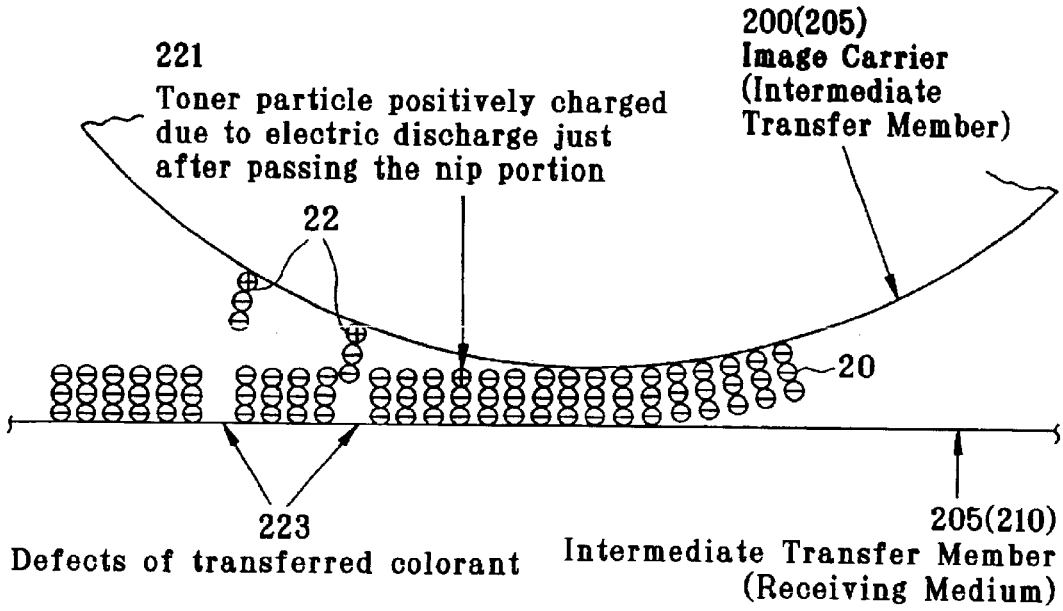
FIG. 16 is an illustration schematically showing an example of creation of defects of transferred colorant due to electric discharge.

FIG. 16 is an illustration schematically showing an example of creation of defects of transferred colorant due to electric discharge.

It is assumed that negatively charged toner particles 20 adhere to an image carrier 200 or an intermediate transfer member 205 in a form of three stories and that the toner particles are transferred to the intermediate transfer member 205 or a receiving medium 210 at a nip portion. At a point where a predetermined space is created after passing through the nip portion, electric discharge may be generated particularly at non-image areas by a transfer electric field. As a result, some of negatively charged toner particles may be positively charged so as to change its polarity to the positive polarity. Assuming that toner particles of the outermost story are positively charged as shown in FIG. 16, the toner particles 22 are attracted to the image carrier 200 or the intermediate transfer member 205 by the transfer electric field and even the negatively charged toner particles are also attracted together by the adhesive force between the toner particles so that the toner particles 22 piled in three stories are reversely transferred, thus generating residual toner particles and creating defects of transferred colorant 223. These may be serious image defects.

Figure 17:
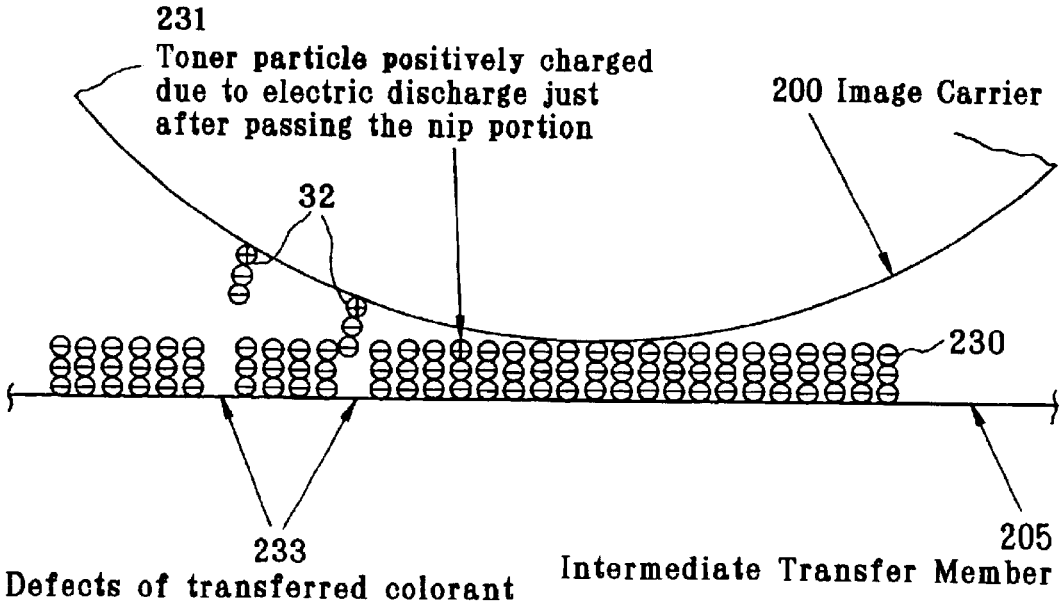
FIG. 17 is an illustration schematically showing an example of creation of defects of transferred colorant due to electric discharge.

FIG. 17 is an illustration schematically showing an example of creation of defects of transferred colorant due to electric discharge between the image carrier and the intermediate transfer member.

In one transferring cycle, when a space is created between an image carrier and an intermediate transfer member after negatively charged toner particles 230 already transferred to the intermediate transfer member 205 pass through a nip portion relative to the image carrier, similarly to the case shown in FIG. 16, electric discharge is generated particularly at non-image areas by the transfer electric field so that some toner particles 32 of the outermost story are positively charged. The positively charged toner particles and the negatively charged toners are reversely transferred together as three-story toners, thus generating color mixture and creating defects of transferred colorant 233. These may be serious image defects.

The method of preventing the creation of defects of transferred colorant as described above will be described with reference to FIG. 18.

Figure 18:
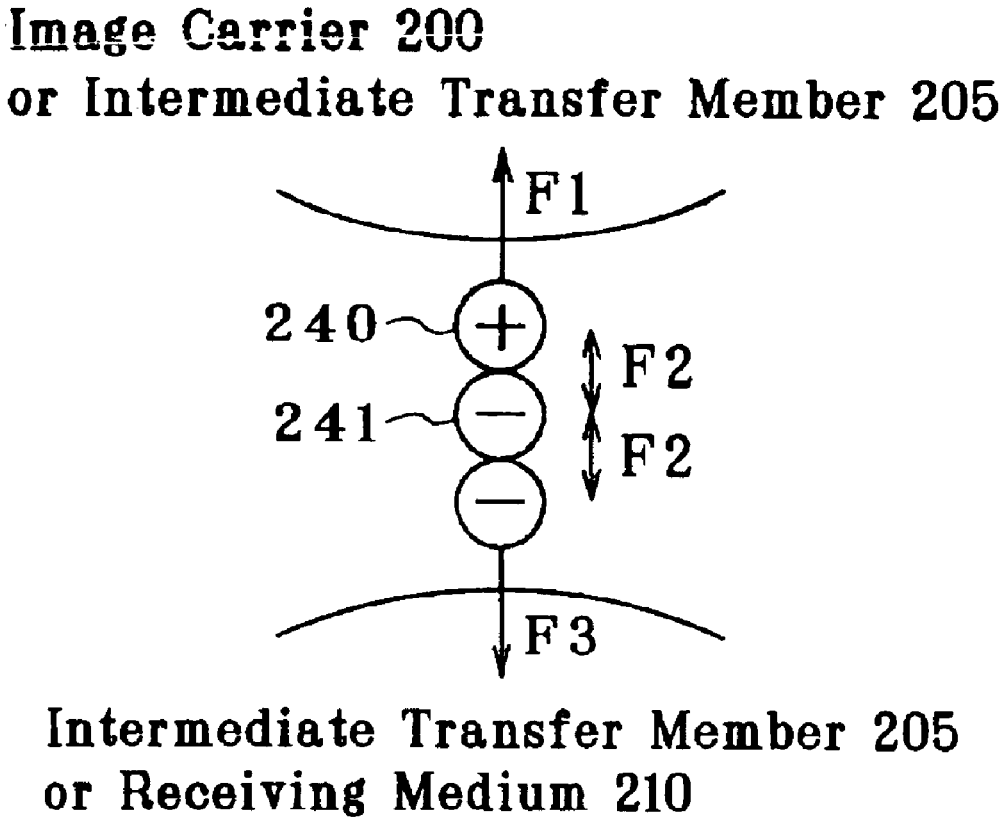
FIG. 18 is a schematic diagram for explaining how to prevent the creation of defects of transferred colorant due to electric discharge.

FIG. 18 is a schematic diagram for explaining how to prevent the creation of defects of transferred colorant due to electric discharge.

In FIG. 18, among toner particles transferred by a transfer electric field between an image carrier 200 or an intermediate transfer member 205 and the intermediate transfer member 205 or a receiving medium 210, a toner particle 240 of the outermost story is positively charged by electric discharge. The negatively charged toner particles may be reversely transferred together with the positively charged toner particle due to the adhesive force therebetween. To prevent such reverse transfer, the following expression is satisfied:

$$F2<F3 \tag{12}$$

wherein F1 is the adhesive force between the toner particle and the image carrier or the intermediate transfer member, F2 is the adhesive force between the toner particles, and F3 is the adhesive force between the toner particle and the intermediate transfer member or the receiving medium 210. When the expression (12) is satisfied, story-to-story separation of the toner occurs when the adhesive force F1 acts on the positively charged toner particle 240 because the adhesive force between the toner particle and the intermediate transfer member or the receiving medium is larger than the adhesive force between the toner particles, thereby preventing the toner particles of at least one story from being reversely transferred and thus preventing the creation of void of toner particles of all stories.

Though a single-component non-magnetic toner has mother particles of which surfaces are coated with external additives, deterioration due to repetition of circulation makes some external additives to be embedded into the mother particles and/or releases some external additives from the surfaces of the mother particles so as to reduce the amount of external additives on the surfaces of the mother particles. In addition, even a new toner includes liberated mother particles by a several percent. As for toner particles deteriorated and having reduced amount of external additives and liberated mother particles, the adhesive force F2 between particles is increased. Even in case of the adhesive forces F2 between mother particles, the adhesive force F2 and the adhesive force F3 between the mother particle and the intermediate transfer member or the receiving medium are set to satisfy the above expression (12), thereby completely preventing the creation of defects of transferred colorant.

Prevention against the creation of defects of transferred colorant in FIG. 16, FIG. 17 will be described with reference to FIG. 19, FIG. 20.

Figure 19:
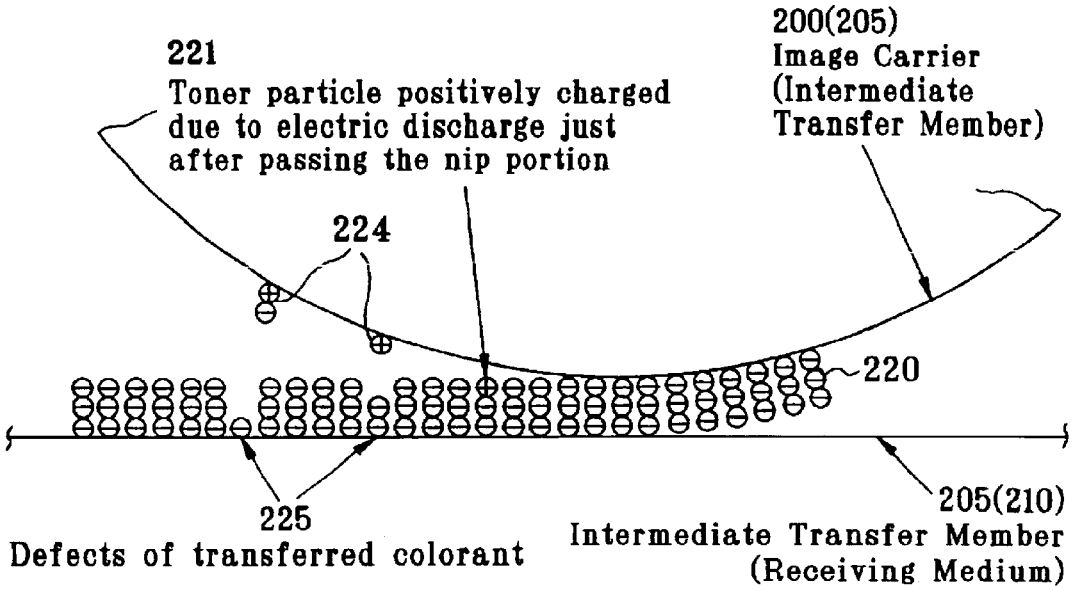
FIG. 19 is an illustration schematically showing the prevention against the creation of defects of transferred colorant due to electric discharge between an image carrier or an intermediate transfer member and an intermediate transfer member or a receiving medium.

FIG. 19 is an illustration schematically showing the prevention against the creation of defects of transferred colorant due to electric discharge between an image carrier or an intermediate transfer member and an intermediate transfer member or a receiving medium.

Similarly to the case shown in FIG. 16, it is assumed that negatively charged toner particles 220 adhere to an image carrier 200 or an intermediate transfer member 205 in a form of three stories and that the toner particle of the outermost story is positively charged to become a positively charged toner particle 221 by ions. The positively charged toner particle is attracted to the image carrier 200 or the intermediate transfer member 205 by a transfer electric field. When the expression (12) is satisfied, however, story-to-story separation of the toner is caused so that toner particle(s) of one or two stories are not reversely transferred to stay while the other toner particle(s) 224 are reversely transferred, thereby preventing all of toner particles at defects of transferred colorant 225 from removed as the case shown in FIG. 16. As a result, the creation of void of toner particles of all stories can be prevented, so the creation of serious image defects can be prevented.

Figure 20:
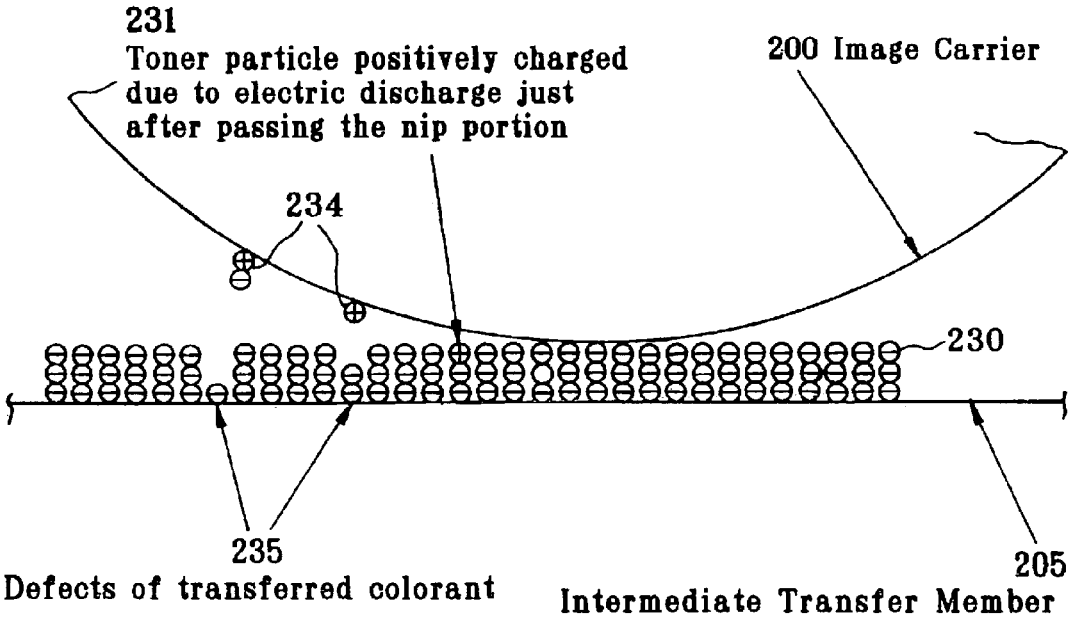
FIG. 20 is an illustration schematically showing the prevention against the creation of defects of transferred colorant due to electric discharge between an image carrier and an intermediate transfer member.

FIG. 20 is an illustration schematically showing the prevention against the creation of defects of transferred colorant due to electric discharge between an image carrier and an intermediate transfer member.

Similarly to the case shown in FIG. 17, immediately after negatively charged toner particles 230 of three stories transferred to an intermediate transfer member pass through a nip portion, electric discharge is generated so as to positively charge one of the toner particles 231 of the outermost story. The positively charged toner 231 is attracted to the image carrier by a transfer electric field. When the expression (12) is satisfied, however, story-to-story separation of the toner is caused so that toner particle(s) of one or two stories are not reversely transferred to stay while the other toner particle(s) 234 are reversely transferred, thereby leaving some toner particles at defects of transferred colorant 235 as the case shown in FIG. 17. As a result, the creation of void of toner particles of all stories can be prevented, so the creation of serious image defects can be prevented.

Now, example of toner satisfying the expression (12) will be explained below:

(I') a polymerized toner (having a sharp particle size distribution compared to a pulverized toner) without exposed wax on the surfaces of polymerized toner particles.

(II') a toner of which the degree of sphericity is 0.95 or more, the surface energy is reduced, and the contact area is reduced, to have reduced adhesive force. The degree of sphericity of toner is a mean sphericity measured by a measuring device FPIA-2100 available from Sysmex Corporation. The degree of sphericity is obtained from the degree of circularity of a two-dimensional projected image of toner particle (the circumference of a complete circle having the same area as that of the projected image/the circumferential length of the projected image).

(III') a toner in which the weight percentage of external additives coating mother particles is 1.6% or more relative to the weight of the toner. Since external additives have an effect of improving the fluidity of the toner, use of 1.6% or more external additives for coating reduces the adhesive force.

(IV') a toner in which the weight percentage of large-particle external additives (30 nm or more in diameter) is 0.5% or more relative to the weight of the toner. The large-particle external additives reduce the adhesive force. When the large-particle external additives enter between the toner and a member of an apparatus, van der Waals force can be reduced.

The intermediate transfer member has a belt of which outermost layer is made of urethane, polyester, polycarbonate, PET, or the like and the surface roughness Ra thereof is 0.1 $\mu$m or more.

In Example 7, the toner and the intermediate transfer member as mentioned above are used. Tablets are made by compressing the toner. The tablet is rubbed on the intermediate transfer member and on the other tablet and the coefficients of generated friction are measured. Example 7 will be described.

EXAMPLE 7

In a full-color electrophotographic printer, its engineering characteristic comprises a toner X (including at least one of the above toners (I') through (IV') and an intermediate transfer member A (including at least one of the above intermediate transfer members. The toner X is compressed at 100–500 kgf/cm$^2$ into tablets. One of the tablets is pressed against a sheet made of the same surface material as that of the image carrier at 20 gf/cm$^2$–400 gf/cm$^2$ and is slid on the sheet (fixed) to obtain a coefficient of friction. One of the tablets is fixed and another tablet is sled relative to the fixed tablet in the same manner to obtain a coefficient of friction. By using the toner satisfying that the coefficient of friction between the tablet and the sheet is larger than the coefficient of friction between the tablets, an image is formed. It is recognized that the formed image has no void of toner particles of all stories which are generated in the conventional art.

As reverse transfer of an image area on the image carrier (reverse transfer is a phenomenon that toner particles already transferred are affected by electric discharge just after passing a nip portion, just after the transfer, or just after passing the nip portion in every circle of the intermediate transfer member so as to change its polarity to the opposite polarity and thus move back to the image carrier) occurs at the transfer portion, toner particles on the image area move back from the intermediate transfer member to the image carrier. During this, these toner particles are attracted by the toner particle of the outermost story of the toner on the intermediate transfer member and are all transferred to the image carrier, thus resulting in a serious image defect as a void of toner particles of all stories.

Therefore, by satisfying the relation among the adhesive forces according to the seventh aspect of the invention, the creation of voids of toner particles of all stories can be prevented because only the toner particle of the outermost story is transferred to the image carrier when reverse transfer occurs due to electric discharge. Also in the secondary transfer (from the intermediate transfer member to a receiving medium), the creation of voids of toner particles of all stories due to electric discharge just after passing a secondary transfer nip portion can be prevented by satisfying the expressions with regard to the relations of adhesive forces similar to those in case of the primary transfer.

Description will now be made as regard to the eighth aspect of the invention directed to prevent the creation of defects of transferred colorant at a secondary transfer portion.

Figure 21:
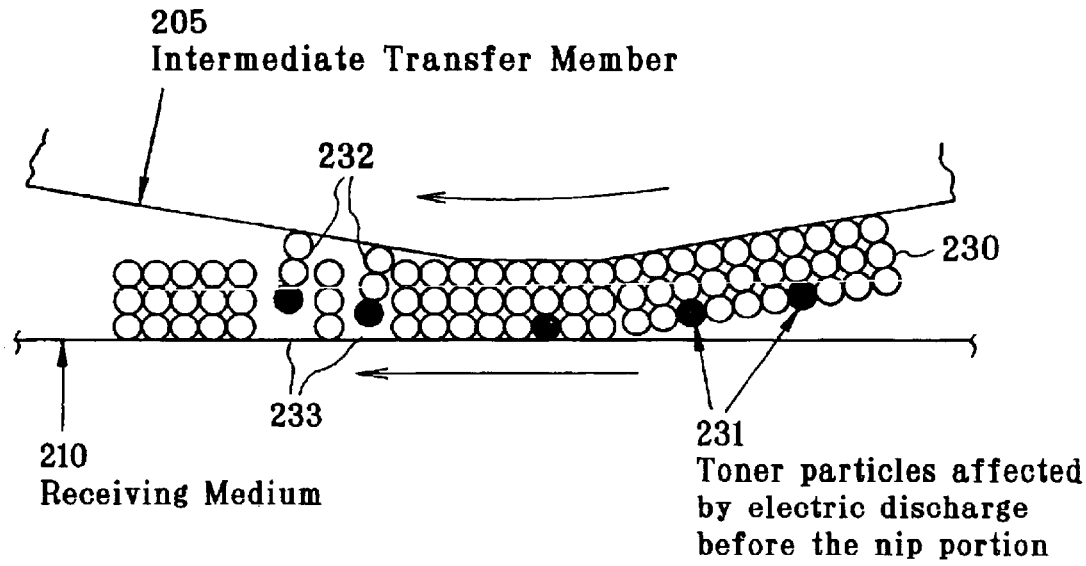
FIG. 21 is an illustration schematically showing an example of creation of defects of transferred colorant due to electric discharge before a nip portion.

FIG. 21 is an illustration schematically showing an example of creation of defects of transferred colorant due to electric discharge before a nip portion.

At a point where a predetermined space exists between the intermediate transfer member and a receiving medium during negatively charged toner particles 230 adhere to an intermediate transfer member 205 come closer to a nip portion being in contact with a receiving medium, electric discharge may be generated by a transfer electric field. As a result, some of negatively charged toner particles of the outermost story may be positively charged so as to change its polarity to the positive polarity due to ions generated by electric discharge (or reduce its charge). Assuming that some toner particles 231 of the outermost story facing the receiving medium are positively charged to change its polarity to the positive polarity (or reduce its charge), the toner particles having positive polarity or reduced charge are attracted to the intermediate transfer member and are thus hardly transferred to the receiving medium. As a result, toner particles 232 piled in three stories consisting of the toner particles having positive polarity or reduced charge and the negatively charged toner particles of the other stories are all transferred to the intermediate transfer member (reverse transfer) after passing the nip portion so that these toner particles become residual toner particles on the intermediate transfer member while defects of transferred colorant 233 are created on the receiving medium. These may be serious image defects.

Figure 22:
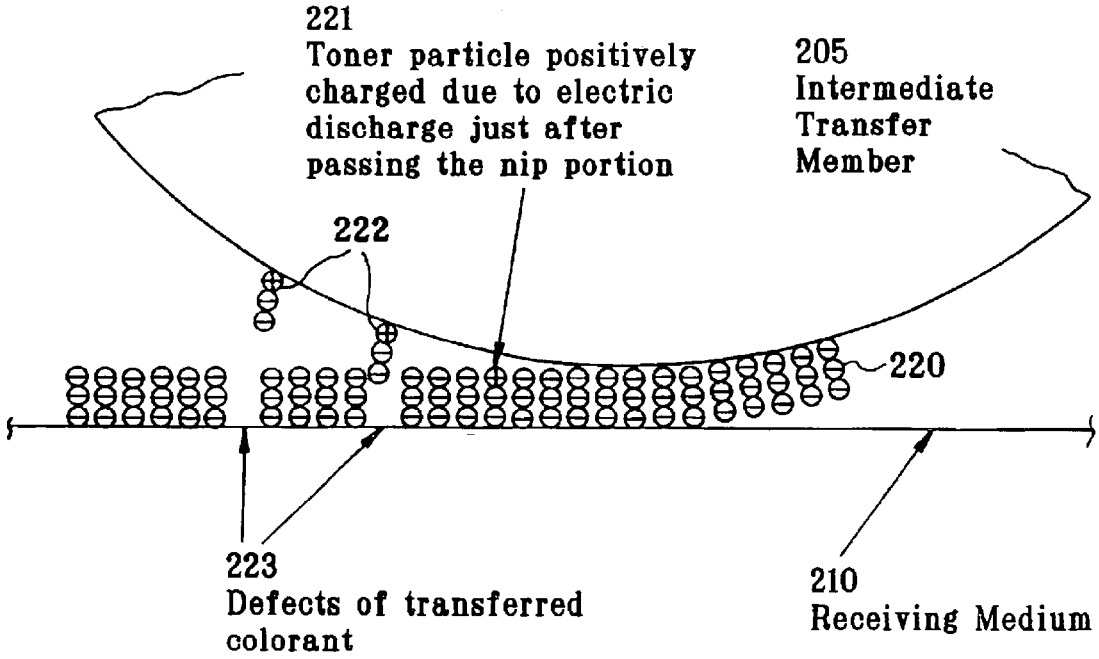
FIG. 22 is an illustration schematically showing an example of creation of defects of transferred colorant due to electric discharge after the nip portion.

FIG. 22 is an illustration schematically showing an example of creation of defects of transferred colorant due to electric discharge after the nip portion.

It is assumed that negatively charged toner particles 220 adhere to an intermediate transfer member 205 in a form of three stories and that the toner particles are transferred to a receiving medium 210 at a nip portion. At a point where a predetermined space is created after passing through the nip portion, electric discharge may be generated by a transfer electric field. As a result, some of negatively charged toner particles of the outermost story may be positively charged so as to change its polarity to the positive polarity (or reduce its charge) by ions generated by the electric discharge. Assuming that toner particles 221 of the outermost story facing the intermediate transfer member are positively charged, the toner particles 221 are attracted to the intermediate transfer member 205 by the transfer electric field and even the negatively charged toner particles are also attracted together by the adhesive force between the toner particles so that the toner particles 222 piled in three stories are reversely transferred, thus generating residual toner particles on the intermediate transfer member and creating defects of transferred colorant 223 on the receiving medium. These may be serious image defects.

The method of preventing the creation of defects of transferred colorant due to electric discharge at the transfer portion as described above will be described with reference to FIG. 23.

Figure 23A:
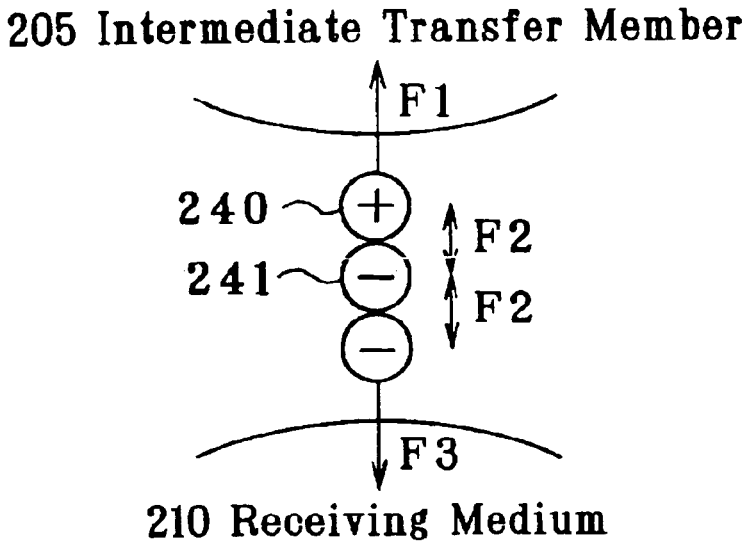
FIGS. 23(*a*), 23(*b*) are schematic illustrations for explaining how to prevent the creation of defects of transferred colorant due to electric discharge.
Figure 23B:
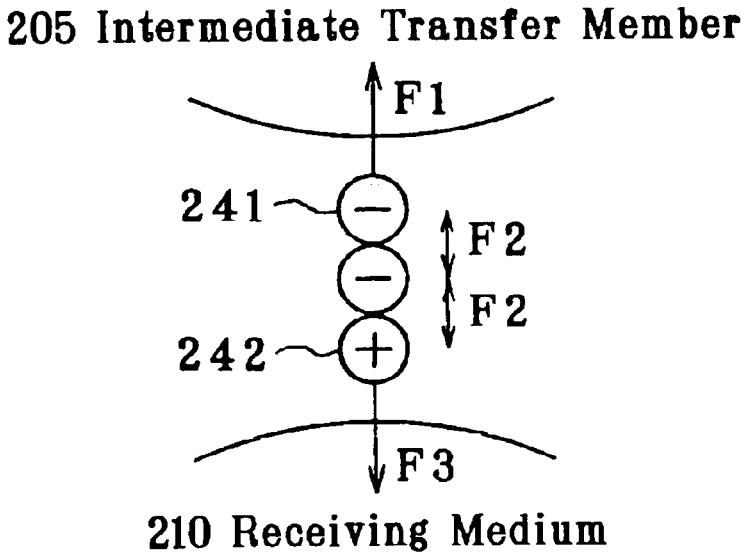

FIGS. 23(*a*), 23(*b*) are schematic illustrations for explaining how to prevent the creation of defects of transferred colorant due to electric discharge at the transfer portion.

In FIGS. 23(*a*), 23(*b*), among toner particles transferred by a transfer electric field between an intermediate transfer member 205 and a receiving medium 210, a toner particle 240 of the outermost story facing the intermediate transfer medium is positively charged by electric discharge after passing a nip portion (FIG. 23(*a*)) or a toner particle 242 of the outermost story facing the receiving medium 210 is positively charged by electric discharge before passing the nip portion (FIG. 23(*b*)). The negatively charged toner particles may be reversely transferred together with the positively charged toner particle 240 or 242 due to the adhesive force therebetween. To prevent such reverse transfer, the following expression is satisfied:

$$F1<F2<F3 \tag{13}$$

wherein F1 is the adhesive force between the toner particle and the intermediate transfer member, F2 is the adhesive force between the toner particles, and F3 is the adhesive force between the toner particle and the receiving medium. By satisfying the expression (13), story-to-story separation of the toner is prevented even when the toner particle is positively charged by the electric discharge at the transfer portion and is thus attracted to the intermediate transfer member. This is because the adhesive force between the toner particles is larger than the adhesive force between the toner particle and the intermediate transfer member (F1<F2). In addition, since the adhesive force between the toner particle and the receiving medium is larger than the adhesive force between the toner particles (F2<F3), toner particles are brought back to the receiving medium, thereby preventing the creation of defects of transferred colorant. Further, the adhesive force between the toner particle and the receiving medium is larger than the adhesive force between the toner particle and the intermediate transfer member (F1<F3), thereby preventing the toner particles of all three stories from being reversely transferred. That is, by satisfying the expression (13), the occurrence of reverse transfer due to electric discharge is prevented and the creation of defects of transferred colorant is thus prevented.

Prevention against the creation of defects of transferred colorant in FIG. 21, FIG. 22 will be described with reference to FIG. 24, FIG. 25.

Figure 24:
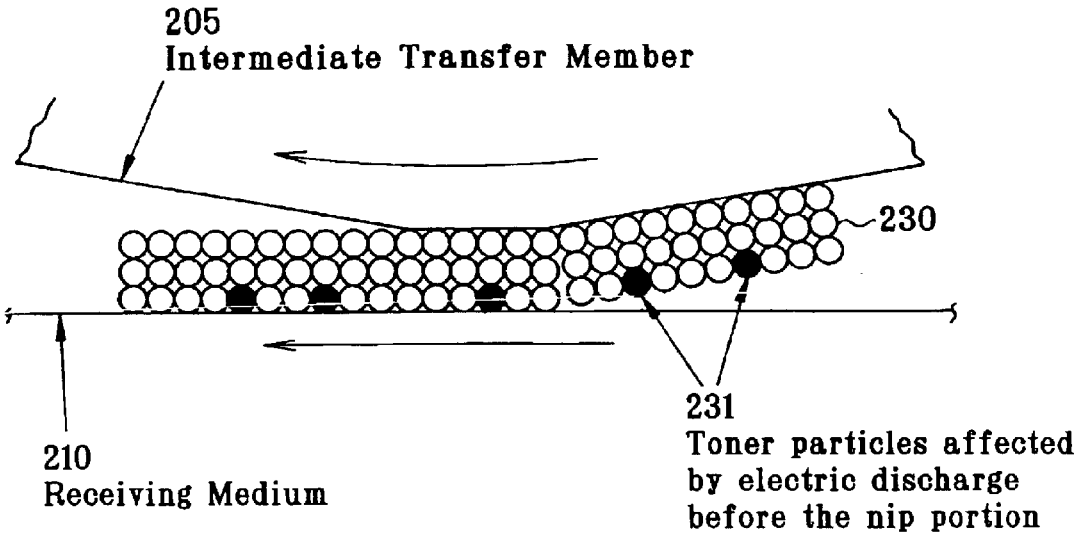
FIG. 24 is an illustration schematically showing the prevention of creation of defects of transferred colorant due to electric discharge before passing the nip portion.

FIG. 24 is an illustration schematically showing the prevention of creation of defects of transferred colorant due to electric discharge immediately before passing the nip portion.

Similarly to the case described with regard to FIG. 21, negatively charged toner particles 230 adhere to an intermediate transfer member in the form of three stories. Among them, some toner particles 231 of the outermost story are positively charged to change its polarity to the positive polarity or to reduce its charge due to electric discharge generated immediately before a nip portion. By satisfying the expression (13), story-to-story separation of the toner is prevented even when the toner particles positively charged by the electric discharge are attracted to the intermediate transfer member. This is because the adhesive force between the toner particles is larger than the adhesive force between the toner particle and the intermediate transfer member. In addition, the adhesive force between the toner particle and the receiving medium is larger than the adhesive force between the toner particles, thereby preventing the toner particles of all three stories from being reversely transferred. That is, the occurrence of reverse transfer due to electric discharge is prevented and the creation of defects of transferred colorant is thus prevented.

Figure 25:
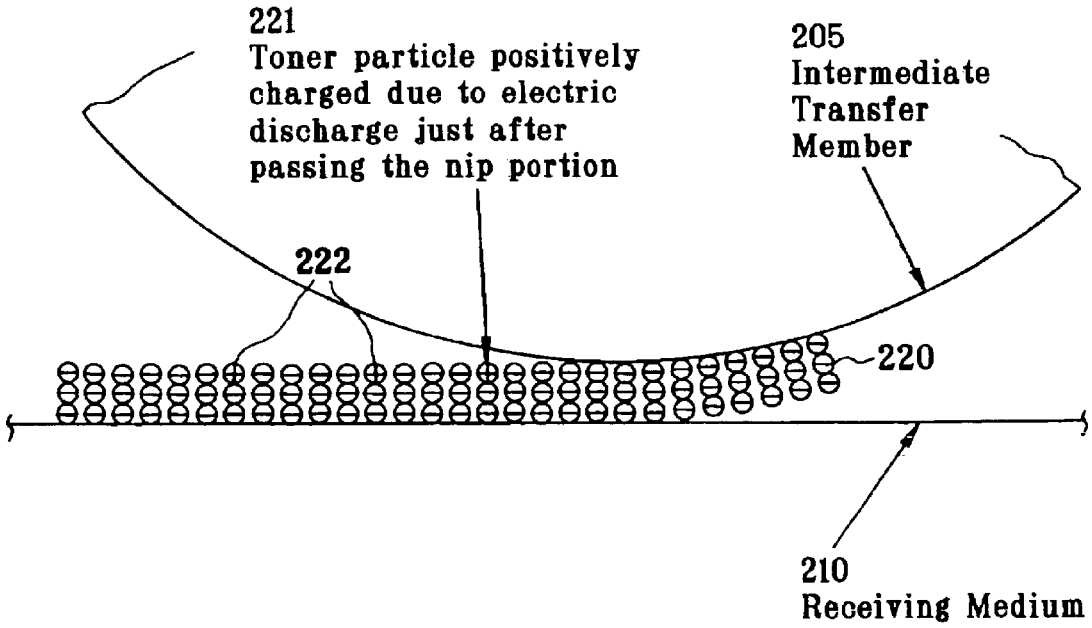
FIG. 25 is an illustration schematically showing the prevention of creation of defects of transferred colorant due to electric discharge after passing the nip portion.

FIG. 25 is an illustration schematically showing the prevention of creation of defects of transferred colorant due to electric discharge after passing the nip portion.

Similarly to the case described with regard to FIG. 22, negatively charged toner particles 220 adhere to an intermediate transfer member 205 in the form of three stories. Among them, some toner particles of the outermost story are positively charged by ions to become positively charged toner particles 221 immediately after a nip portion. By satisfying the expression (13), story-to-story separation of the toner is prevented even when the toner particles positively charged by the electric discharge are attracted to the intermediate transfer member because of transfer electric field. This is because the adhesive force between the toner particles is larger than the adhesive force between the toner particle and the intermediate transfer member. In addition, the adhesive force between the toner particle and the receiving medium is larger than the adhesive force between the toner particles so that the toner particles are transferred to the receiving medium, thereby preventing the occurrence of reverse transfer and thus preventing the creation of defects of transferred colorant.

As for the intermediate transfer member for satisfying the expression (13), the belt of the intermediate transfer member is made of urethane, polyester, polycarbonate, PET, or the like. The PET may contain a fluorine-containing group or a silicon-containing group. In addition, the surface roughness Ra is 0.1 $\mu$m or more. Reduction in Ra reduces the friction force (adhesive force).

In Example 8, the toner and the intermediate transfer member as mentioned above are used. Tablets are made by compressing the toner. The tablet is rubbed on the intermediate transfer member, on the other tablet, and on the receiving medium and the coefficients of generated friction are measured. Example 8 will be described.

EXAMPLE 8

A toner X is compressed at 100–500 kgf/cm$^2$ into tablets. The tablet is pressed against a sheet made of the same surface material as that of the intermediate transfer member at 20 gf/cm$^2$–400 gf/cm$^2$ and is slid on the sheet (fixed) to obtain a coefficient of friction $\mu 1$. One of the tablets is fixed and another tablet is sled relative to the fixed tablet in the same manner to obtain a coefficient of friction $\mu 2$. The tablet is pressed against the receiving medium at 20 gf/cm$^2$–400 gf/cm$^2$ and is slid on the receiving medium to obtain a coefficient of friction $\mu 3$. By using the toner and using the intermediate transfer member satisfying that the coefficient of friction $\mu 1$ is smaller than the coefficient of friction $\mu 2$ and the coefficient of friction $\mu 2$ is smaller than the coefficient of friction $\mu 3$ ($\mu 1<\mu 2<\mu 3$), transfer is conducted. It is recognized that high transfer efficiency is achieved at the secondary transfer portion and that an output image has no defects of transferred colorant which are generated at the secondary transfer portion in the conventional art.

It must be taken into consideration that the transfer efficiency is affected by the change of the polarity of toner particles into the opposite polarity and variation in the charge of toner particles due to electric discharge just before the transfer nip portion. For this, according to the eighth aspect of the invention, a condition that the adhesive force between the toner particles is larger than the adhesive force between the toner particle and the intermediate transfer member and a condition that the adhesive force between the toner particle and the receiving medium is larger than the adhesive force between the toner particles are satisfied. Accordingly, even when the polarity of a toner particle is changed to the opposite polarity or the charge of a toner particle is reduced, the toner particle is easily separated from the intermediate transfer member because the adhesive force therebetween is small and, in addition, the toner particle affected by electric discharge can be transferred with the surrounding toner particles because the adhesive force between the toner particles is large, thereby increasing the transfer efficiency and thus preventing the creation of defects of transferred colorant.

As reverse transfer of an image area on the intermediate transfer member (reverse transfer is a phenomenon that toner particles already transferred are affected by electric discharge just after passing a nip portion so as to change its polarity to the opposite polarity and thus move back to the intermediate transfer member) occurs at the transfer portion due to electric discharge just after the transfer nip portion, toner particles on the image area move back from the receiving medium to the intermediate transfer member, thus resulting in a serious image defect as a defect of transferred colorant. Therefore, by satisfying the condition that the adhesive force between the toner particles is larger than the adhesive force between the toner particle and the intermediate transfer member and that the adhesive force between the toner particle and the receiving medium is larger than the adhesive force between the toner particles, the occurrence of story-to-story separation of toner is prevented and the reverse transfer is never caused, thereby preventing the generation of residual toner particles on the intermediate transfer member and also preventing the creation of defects of transferred colorant on the receiving medium.

What we claim is:

1. An image forming apparatus comprising toner particles including resin mother particles of which surfaces are coated with external additives, wherein the adhesive force between a primary transfer member and the toner particle is larger than the adhesive force between an image carrier and the toner particle and wherein the adhesive force between the primary transfer member and the resin mother particle is larger than the adhesive force between the image carrier and the resin mother particle.

2. An image forming apparatus as claimed in claim 1, wherein the adhesive force between a secondary transfer member and the toner particle is larger than the adhesive force between the primary transfer member and the toner particle and wherein the adhesive force between the secondary transfer member and the resin mother particle is larger than the adhesive force between the primary transfer member and the resin mother particle.

3. An image forming apparatus as claimed in claim 1 or 2, wherein said image forming apparatus includes a plurality of image forming units each having an image carrier.

4. An image forming apparatus as claimed in claim 1 or 2, wherein the degree of sphericity of the toner particles is 0.95 or more.

5. An image forming apparatus as claimed in claim 1 or 2, wherein the toner particles are polymerized toner particles.

6. An image forming apparatus of cleaner-less system comprising toner particles including resin mother particles of which surfaces are coated with external additives, wherein the adhesive force between the resin mother particles is larger than the adhesive force between the resin mother particle and the image carrier.

7. An image forming apparatus of cleaner-less system comprising toner particles including resin mother particles of which surfaces are coated with external additives, wherein the adhesive force between the resin mother particle and the image carrier is smaller than both the adhesive force between the resin mother particles and the adhesive force between the resin mother particle and a transfer member.

8. An image forming apparatus as claimed in claim 6 or 7, wherein said image forming apparatus includes a plurality of image forming units each having an image carrier.

9. An image forming apparatus as claimed in claim 6 or 7, wherein the adhesive force between the image carrier and the resin mother particle is reduced by providing differences in velocity therebetween during transfer.

10. An image forming apparatus comprising toner particles including resin mother particles of which surfaces are coated with external additives, in which images with toner particles of different colors are superposed at a transfer portion, wherein the adhesive force between the resin mother particles of at least two different colors is larger than the adhesive force between the image carrier and the resin mother particle.

11. An image forming apparatus comprising toner particles including resin mother particles of which surfaces are coated with external additives, in which images with toner particles of different colors are superposed at a transfer portion, wherein the adhesive force between the resin mother particle and the image carrier is smaller than both the adhesive force between the resin mother particles of at least two different colors and the adhesive force between the resin mother particle and a transfer member.

12. An image forming apparatus as claimed in claim 10 or 11, wherein said image forming apparatus includes a plurality of image forming units each having an image carrier.

13. An image forming apparatus as claimed in claim 10 or 11, wherein the adhesive force between the image carrier and the resin mother particle is reduced by providing differences in velocity therebetween during transfer.

14. An image forming apparatus having an intermediate transfer member and comprising toner particles including resin mother particles of which surfaces are coated with external additives, wherein the adhesive force between the resin mother particles is larger than the adhesive force between the resin mother particle and the intermediate transfer member.

15. An image forming apparatus as claimed in claim 14, wherein said image forming apparatus includes a plurality of image forming units each having an image carrier.

16. An image forming apparatus having an intermediate transfer member and comprising toner particles including resin mother particles of which surfaces are coated with external additives, wherein the adhesive force between the toner particle and the intermediate transfer member or a receiving medium is larger than the adhesive force between the toner particles.

17. An image forming apparatus as claimed in claim 16, wherein said toner particles are liberated mother particles or deteriorated toner particles which are coated with the reduced amount of external additives.

18. An image forming apparatus as claimed in claim 16 or 17, wherein said image forming apparatus includes a plurality of image forming units each having an image carrier.

19. An image forming apparatus as claimed in claim 16 or 17, wherein the degree of sphericity of said toner particles is 0.95 or more.

20. An image forming apparatus as claimed in claim 16 or 17, wherein the toner particles are polymerized toner particles.

21. An image forming apparatus as claimed in claim 16 or 17, wherein the toner particles include 1.6% or more by weight of external additives.

22. An image forming apparatus as claimed in claim 16 or 17, wherein the toner particles include 0.5% or more by weight large-particle external additives, with a large-particle being 30 nm or more in diameter.

23. An image forming apparatus having an intermediate transfer member and comprising toner particles including mother particles of which surfaces are coated with external additives, wherein the adhesive force between the toner particles is larger than the adhesive force between the toner particle and the intermediate transfer member and wherein the adhesive force between the toner particle and a receiving medium is larger than the adhesive force between the toner particles.

24. An image forming apparatus as claimed in claim 23, wherein said image forming apparatus includes a plurality of image forming units each having an image carrier.

25. An image forming apparatus as claimed in claim 1, wherein the image forming apparatus uses the adhesive forces to reduce residual adhesion, without mechanical cleaners, of at least one of toner particles and resin mother particles to at least one of the primary transfer member and the image carrier.

* * * * *